US011739919B2

(12) United States Patent
Weir et al.

(10) Patent No.: US 11,739,919 B2
(45) Date of Patent: Aug. 29, 2023

(54) PANEL, SYSTEM, KIT OF PARTS AND METHODS

(71) Applicant: Inspace Media Ltd, Kent (GB)

(72) Inventors: Andrew Weir, Kent (GB); James Frost, Kent (GB)

(73) Assignee: INSPACE MEDIA LTD., Kent (GB)

( * ) Notice: Subject to any disclaimer, the term of this patent is extended or adjusted under 35 U.S.C. 154(b) by 27 days.

(21) Appl. No.: 17/625,862

(22) PCT Filed: Mar. 27, 2020

(86) PCT No.: PCT/GB2020/050841
§ 371 (c)(1),
(2) Date: Jan. 10, 2022

(87) PCT Pub. No.: WO2021/005322
PCT Pub. Date: Jan. 14, 2021

(65) Prior Publication Data

US 2022/0260237 A1 Aug. 18, 2022

(30) Foreign Application Priority Data

Jul. 10, 2019 (GB) ..... 1909866
Jul. 19, 2019 (GB) ..... 1910344

(51) Int. Cl.
*F21V 21/08* (2006.01)
*F21S 43/14* (2018.01)
(Continued)

(52) U.S. Cl.
CPC ..... *F21V 21/0808* (2013.01); *F21S 43/14* (2018.01); *F21V 9/06* (2013.01); *F21V 9/30* (2018.02); *F21V 23/02* (2013.01)

(58) Field of Classification Search
CPC ..... F21S 43/14–145; F21V 9/06–30; F21V 21/0808; F21V 23/02; G09F 13/22; G09F 19/22; G09F 21/04–18; G09F 2013/227
See application file for complete search history.

(56) References Cited

U.S. PATENT DOCUMENTS 5,005,306 A 4/1991 Kinstler
5,838,644 A * 11/1998 Yoneda ..... G04B 19/32 368/239
2011/0198015 A1 8/2011 Anderson et al.

FOREIGN PATENT DOCUMENTS

CN 204884495 U 12/2015
EP 1111966 A2 6/2001
JP 2004151629 A 5/2004

OTHER PUBLICATIONS

International Search Report, dated Feb. 16, 2021, issued in International Application No. PCT/GB2020/050841.

* cited by examiner

*Primary Examiner* — Jason M Han
(74) *Attorney, Agent, or Firm* — Saul Ewing LLP

(57) ABSTRACT

There is disclosed a flexible panel, including (i) a fluorescent layer; (ii) an electroluminescent panel layer arranged to illuminate the fluorescent layer; (iii) an ultraviolet protection layer, transparent to visible light, arranged on a front face of the flexible panel to protect the fluorescent layer, and (iv) an adhesive layer; wherein the adhesive layer is arranged on a rear face of the flexible panel, such that the flexible panel is attachable to a surface. There are further disclosed related systems including such flexible panels and a power supply for the flexible panel; objects including such systems; related kits of parts; related methods of assembly; related
(Continued)

methods of connection; and connector systems suitable for connecting such flexible panels to a power supply for the flexible panel.

20 Claims, 18 Drawing Sheets

(51) Int. Cl.

| | |
|---|---|
| ***F21V 9/30*** | (2018.01) |
| ***F21V 9/06*** | (2018.01) |
| ***F21V 23/02*** | (2006.01) |

PANEL, SYSTEM, KIT OF PARTS AND METHODS

CROSS REFERENCE TO RELATED APPLICATIONS

This application claims the priority of International Application No. PCT/GB2020/050841, filed on Mar. 27, 2020, which claims priority to GB Application No. 1909866.4, filed on Jul. 10, 2019, and GB Application No. 1910344.9, filed on Jul. 19, 2019, the entire contents of which are fully incorporated herein by reference.

BACKGROUND OF THE INVENTION

1. Field of the Invention

The field of the invention relates to flexible panels including an electroluminescent layer; to systems including such flexible panels and a power supply for the flexible panel; to objects including such systems; to related kits of parts; to related methods of assembly; to related methods of connection; and to connector systems suitable for connecting such flexible panels to a power supply for the flexible panel.

2. Technical Background

Electroluminescence or 'EL' is an amazing way to illuminate sign artwork. Not only can we illuminate the artwork similarly to a backlit sign, we have the ability to program the illumination to animate. These signs are thin and can be applied in a wide variety of applications.

In the early 1960's aircraft manufacturers began using electroluminescence to illuminate instrument panels. Since then, EL has been employed in a number of commercial applications such as backlighting clocks and watches, computer displays and keypad illumination for hand-held devices.

For an EL light-emitting film, the brightness of the surface appears the same, or almost the same, from all angles of view; electroluminescent light emission is not directional. The light emitted from the surface is homogeneous and is well-perceived by the eye. An EL film produces light that may have a very narrow spectral bandwidth, and is uniform.

In an example, electroluminescent signage is essentially a flat light bulb sandwich including layers of conductive and non-conductive plastic and a layer of phosphor. The phosphor is laminated between two conductive layers and, as a voltage is applied between the two conductive layers, or electrodes, the phosphor emits light energy. When a high-resolution image is printed over the electroluminescent material, the resulting assembly behaves like a backlit sign. The illuminated phosphor does not generate heat the way conventional light sources do, so EL runs at a relatively cool temperature. You can encapsulate or enclose the EL panels without fear of them overheating or melting.

It is desirable to provide illumination on vehicles, over a relatively large area of the vehicle, rather than just over an area typical of a vehicle lamp area, for example for safety applications.

3. Discussion of Related Art

EP1110816 (A2) discloses an electroluminescent vehicle lamp made with a lens plate, a back plate, electroluminescent sheet, first electrical connector, second electrical connector. The lamp has decreased volume and weight due to its small thickness. The electroluminescent vehicle lamp provides a vehicle signal lamp with a small thickness that is otherwise conformal with the surface of a vehicle. A particular advantage of the lamp structure is that the vehicle body needs only minimal forming to accommodate the positioning of the lamp, and little interior space in the vehicle is required. Two or more color regions can be formed in one housing. Two different states of appearance exist such that the device can exhibit a bright operating color (red, yellow, etc.) and yet blend in with the rest of the vehicle exterior in the non-operating mode.

EP1110816 (A2) discloses prior art FIG. 18 which shows a schematic cross sectional view of an electroluminescent vehicle lamp 10. The electroluminescent vehicle lamp 10 may be assembled from a lens plate 12, a back plate 30, and an electroluminescent sheet 50. The lens plate 12 is located adjacent the back plate 30 to thereby define a narrow cavity 20 between the lens plate 12 and the back plate 30, and that encloses the electroluminescent sheet 50.

SUMMARY OF THE INVENTION

According to a first aspect of the invention, there is provided a flexible panel, including (i) a fluorescent layer;

(ii) an electroluminescent panel layer arranged to illuminate the fluorescent layer;

(iii) an ultraviolet protection layer, transparent to visible light, arranged on a front face of the flexible panel to protect the fluorescent layer, and (iv) an adhesive layer;

wherein the adhesive layer is arranged on a rear face of the flexible panel, such that the flexible panel is attachable to a surface.

An advantage is that the flexible panel can conform to the shape of a non-flat surface (e.g. a cylindrically curved surface) on which it is mounted, because of its flexibility. An advantage is that the flexible panel can conform to a range of shapes of non-flat surfaces on which it may be mounted, because of its flexibility. An advantage is that a particular light emission colour can be provided from the flexible panel, through selection of the fluorescent layer. An advantage is that the layers below the ultraviolet protection layer are protected from ultraviolet radiation (e.g. solar ultraviolet radiation present outdoors during the day).

In an alternative flexible panel, the fluorescent layer is not present. In an alternative flexible panel, the adhesive layer is not present.

The flexible panel may be one wherein the flexible panel includes an optically opaque pattern layer arranged so as to be visible from the front face of the flexible panel. An advantage is that an opaque pattern can be provided together with illuminated areas, on the flexible panel.

The flexible panel may be one wherein the optically opaque pattern layer is retroreflective. An advantage is that a pattern can be seen well, even when the flexible panel is not illuminated.

The flexible panel may be one wherein the optically opaque pattern layer is an optically opaque chevron pattern layer. An advantage is suitability for use in safety applications, e.g. in road safety applications.

The flexible panel may be one wherein the optically opaque chevron pattern layer is arranged such as to leave visible a chevron pattern of the fluorescent layer. An advantage is suitability for use in safety applications, e.g. in road safety applications.

The flexible panel may be one wherein the fluorescent layer is a first colour, and the optically opaque pattern layer is a second colour, different to the first colour. An advantage is suitability for use in safety applications. Possible first colour and second colour sets are: yellow and black; yellow and blue; yellow and green; white and red; yellow and red.

The flexible panel may be one wherein the fluorescent layer is yellow, and the optically opaque pattern layer is red. An advantage is suitability for use in safety applications, e.g. in road safety applications.

The flexible panel may be one wherein the fluorescent layer is white, and the optically opaque pattern layer is red. An advantage is suitability for use in safety applications, e.g. in road safety applications.

The flexible panel may be one wherein the optically opaque chevron pattern layer is red and includes red strips being no less than 150 mm apart with an incline of between 45-60° to the vertical. An advantage is suitability for use in safety applications, e.g. in road safety applications.

The flexible panel may be one wherein the fluorescent layer is a film. An advantage is ease of assembly during manufacture.

The flexible panel may be one wherein the ultraviolet protection layer is a film. An advantage is ease of assembly during manufacture.

The flexible panel may be one wherein the ultraviolet protection layer includes a ceramic coating. An advantage is abrasion resistance. An advantage is the ceramic coating makes it easier to wash off dirt. An advantage is protection against one or more of graffiti, salt spray, diesel or acid rain staining.

The flexible panel may be one wherein the ceramic coating provides abrasion resistance.

The flexible panel may be one wherein the ceramic coating makes it easier to wash off dirt.

The flexible panel may be one wherein the ceramic coating includes a binder base including organic silane and $SiO_2$. An advantage is abrasion resistance. An advantage is the ceramic coating makes it easier to wash off dirt. An advantage is protection against one or more of graffiti, salt spray, diesel or acid rain staining.

The flexible panel may be one wherein the ceramic coating is in the range of 5 μm to 30 μm in thickness, or in the range of 10 μm to 20 μm in thickness. An advantage is that the ceramic coating is at least as flexible as the flexible panel.

The flexible panel may be one wherein the ceramic coating is an antimicrobial ceramic coating. An advantage is protection against harmful bacteria and mould. An advantage is protection against *E. coli*, MRSA, *Listeria, Legionella, Salmonella, Campylobacter* and/or *Staphylococcus aureus*.

The flexible panel may be one wherein the adhesive layer is a self-adhesive layer or a self-adhesive film. An advantage is ease of attachment to the surface.

The flexible panel may be one wherein the flexible panel is such that edges of the ultraviolet protection layer extend around edges of the flexible panel, but are underneath the self-adhesive layer. An advantage is effective sealing of the flexible panel e.g. against water ingress.

The flexible panel may be one wherein the flexible panel is sealed to prevent water ingress.

The flexible panel may be one wherein the electroluminescent (EL) panel layer is arranged to emit light due to layers of conductive and non-conductive plastic and a layer of phosphor, in the EL panel layer, in which the phosphor is laminated between two conductive layers, and as a voltage is applied between the two conductive layers, or electrodes, the phosphor emits light energy.

The flexible panel may be one wherein the electroluminescent (EL) panel layer comprises a top outer protective laminate which is situated next to an optional filter layer, which is situated next to an ITO (indium tin oxide) clear electrode layer; the ITO layer sits above a glowing phosphor layer, which is above a dielectric insulating layer, which sits above a conductive metal layer; below the conductive metal layer is a bottom outer protective laminate, wherein the ITO clear electrode layer and the conductive metal layer are in connection with an inverter and a power source.

The flexible panel may be one wherein the flexible panel includes electrical connectors for connection of the electroluminescent panel layer to an electrical power system.

The flexible panel may be one wherein the electrical connectors are present on a rear of the flexible panel. An advantage is better protection of the electrical connectors from damage during use of the panel when mounted on the surface.

The flexible panel may be one wherein the electrical connectors are highly flattened. An advantage is that the flexible panel can conform well to a shape of the surface.

The flexible panel may be one wherein the electrical connectors are, or include, copper. An advantage is reduced Joule heating of the flexible panel, in use.

The flexible panel may be one wherein the flexible panel includes a flat flexible conductive ribbon in connection with the electrical connectors, and connectable to a power system. An advantage is that the flexible panel can conform well to a shape of the surface. An advantage is unobtrusive connection to a power system, located behind the surface.

The flexible panel may be one wherein the flexible panel includes a conducting strip or track which is situated around a periphery of the panel, e.g. which runs continuously around a periphery of the panel. An advantage is effective illumination of the electroluminescent panel layer.

The flexible panel may be one wherein the flexible panel includes a conducting strip or track which is situated within the panel area, e.g. within various area portions of the panel area, such as area portions which are defined by slits in the panel. An advantage is effective illumination of the electroluminescent panel layer.

The flexible panel may be one wherein the flexible panel includes an aperture passing from the front face to the rear face. An advantage is that the panel is suitable for use in wide area applications.

The flexible panel may be one wherein the aperture is for a vehicle door handle, or for a vehicle logo or badge. An advantage is that the panel is suitable for use in vehicular applications.

The flexible panel may be one wherein the flexible panel includes a slit. An advantage is that the flexible panel is well-suited for attachment to curved surfaces.

The flexible panel may be one wherein the slit is adapted to enable the flexible panel, when affixed to a vehicle, to conform to a curved shape of the vehicle, such as a curved shape of a rear of a van.

The flexible panel may be one wherein the flexible panel includes a plurality of slits. An advantage is that the flexible panel is well-suited for attachment to curved surfaces.

The flexible panel may be one wherein at least two slits of the plurality of slits are arranged non-parallel to each other, in the flexible panel. An advantage is that the flexible panel is well-suited for attachment to curved surfaces, with various curvatures.

The flexible panel may be one wherein the at least two slits of the plurality of slits are arranged perpendicularly in the flexible panel. An advantage is that the flexible panel is well-suited for attachment to curved surfaces, with various curvatures.

The flexible panel may be one wherein the plurality of slits are adapted to enable the flexible panel, when affixed to a vehicle, to conform to a curved shape of the vehicle, such as a curved shape of a rear of a van.

The flexible panel may be one wherein the flexible panel has an operating temperature of 120° C., or 70° C.

The flexible panel may be one wherein the flexible panel has an operating temperature of −30° C. (minus 30 degrees C.).

The flexible panel may be one wherein the flexible panel does not have sufficient strength to be self-supporting. An advantage is a low weight flexible panel.

The flexible panel may be one wherein the flexible panel is capable of being curled such that the flexible panel lies in a smooth continuous arcuate curve having a diameter of less than 1.0 m. An advantage is that the flexible panel is suited for attachment to curved surfaces.

The flexible panel may be one wherein the flexible panel is capable of being curled such that the flexible panel lies in a smooth continuous arcuate curve having a diameter of less than 50 cm. An advantage is that the flexible panel is well-suited for attachment to curved surfaces.

The flexible panel may be one wherein the flexible panel is capable of being curled such that the flexible panel lies in a smooth continuous arcuate curve having a diameter of less than 20 cm. An advantage is that the flexible panel is very well-suited for attachment to curved surfaces.

The flexible panel may be one wherein the flexible panel includes a flexible power connector mounted on a face of the flexible panel. An advantage is the power connection may not become unreliable, e.g. become cracked, or break off, when the flexible panel is flexed, or when the flexible panel is subjected to a mechanical shock.

The flexible panel may be one wherein the flexible panel including the flexible power connector is capable of being curled such that the flexible panel including the flexible power connector lies in a smooth continuous arcuate curve having a diameter of less than 1.0 m. An advantage is that the flexible panel is suited for attachment to curved surfaces.

The flexible panel may be one wherein the flexible panel including the flexible power connector is capable of being curled such that the flexible panel including the flexible power connector lies in a smooth continuous arcuate curve having a diameter of less than 50 cm. An advantage is that the flexible panel is well-suited for attachment to curved surfaces.

The flexible panel may be one wherein the flexible panel including the flexible power connector is capable of being curled such that the flexible panel including the flexible power connector lies in a smooth continuous arcuate curve having a diameter of less than 20 cm. An advantage is that the flexible panel is very well-suited for attachment to curved surfaces.

The flexible panel may be one wherein the flexible power connector which is mounted on a face of the flexible panel, is in connection with the electroluminescent panel layer, via a controlled solder deposit.

The flexible panel may be one including a flexible electrical connector and tail system including the flexible power connector, a tail and a tail connector. An advantage is ease of retrofitting the flexible panel e.g. in vehicular applications.

The flexible panel may be one including a flexible electrical connector and tail system including the flexible power connector which is a flat printed circuit cable (FPC) connector e.g. a polyimide flat printed circuit cable (FPC) connector. An advantage is ease of retrofitting the flexible panel e.g. in vehicular applications.

The flexible panel may be one wherein the tail thickness is in the range of 50 microns to 500 microns, or the tail thickness is in the range of 100 microns to 300 microns. An advantage is ease of retrofitting the flexible panel e.g. in vehicular applications.

The flexible panel may be one wherein the tail includes a conducting metal layer in the range of 20 microns to 60 microns in thickness, surrounded by a flexible insulating layer in the range from 15 microns to 50 microns thick. An advantage is ease of retrofitting the flexible panel e.g. in vehicular applications.

The flexible panel may be one wherein the tail includes a conducting metal layer e.g. which includes copper. An advantage is reduced Joule heating.

The flexible panel may be one wherein the tail includes a flexible insulating layer e.g. which includes polyimide. An advantage is ease of retrofitting the flexible panel e.g. in vehicular applications.

The flexible panel may be one wherein the tail has a width in the range from 3 mm to 10 mm, or in the range from 3 mm to 30 mm. An advantage is ease of retrofitting the flexible panel e.g. in vehicular applications.

The flexible panel may be one wherein the tail is a ribbon cable. An advantage is ease of retrofitting the flexible panel e.g. in vehicular applications.

The flexible panel may be one wherein the flexible panel has a thickness in the range of 1 mm to 10 mm, or a thickness in the range of 2 mm to 5 mm, or a thickness in the range of 3 mm to 8 mm, or a thickness in the range of 4 mm to 7 mm. An advantage is ease of retrofitting the flexible panel e.g. in vehicular applications.

The flexible panel may be one wherein the flexible panel has a width, when attached to the surface, in the range of 1500 mm to 2100 mm, or in the range of 1000 mm to 1400 mm, or in the range of 1000 mm to 2100 mm, or in the range of 500 mm to 2100 mm. An advantage is improved safety e.g. in road safety applications.

The flexible panel may be one wherein the flexible panel has a height, when attached to the surface, in the range of 600 mm to 850 mm, or in the range of 600 mm to 1300 mm, or in the range of 600 mm to 2000 mm, or in the range of 600 mm to 2800 mm, or in the range of 200 mm to 400 mm, or in the range of 200 mm to 2800 mm. An advantage is improved safety e.g. in road safety applications.

The flexible panel may be one wherein the flexible panel, when illuminated by the electroluminescent panel layer, provides a brightness in the range of 10 to 200 candela per $m^2$, or in the range of 50 to 200 candela per $m^2$, or in the range of 50 to 150 candela per $m^2$. An advantage is improved night time safety e.g. in road safety applications.

The flexible panel may be one wherein the flexible panel has a weight per unit area in the range of from 0.1 to 1.0 $g/cm^2$, or in the range of from 0.3 to 0.8 $g/cm^2$, or in the range of from 0.5 to 0.7 $g/cm^2$. An advantage is ease of retrofitting the flexible panel e.g. in vehicular applications.

According to a second aspect of the invention, there is provided a flexible panel system, the system including a flexible panel and an inverter power system, wherein the flexible panel is in connection with the inverter power system, the flexible panel including:

(i) a fluorescent layer;

(ii) an electroluminescent panel layer arranged to illuminate the fluorescent layer;

(iii) an ultraviolet protection layer, transparent to visible light, arranged on a front face of the flexible panel to protect the fluorescent layer, and (iv) an adhesive layer;

wherein the adhesive layer is arranged on a rear face of the flexible panel, such that the flexible panel is attachable to a surface.

An advantage is that the flexible panel can conform to the shape of a non-flat surface (e.g. cylindrically curved) on which it is mounted, because of its flexibility. An advantage is that the flexible panel can conform to a range of shapes of non-flat surfaces on which it may be mounted, because of its flexibility. An advantage is that a particular light emission colour can be provided from the flexible panel, through selection of the fluorescent layer. An advantage is that the layers below the ultraviolet protection layer are protected from ultraviolet radiation (e.g. solar ultraviolet radiation present outdoors during the day). An advantage is that the system can be used in applications on vehicular surfaces.

In an alternative system, the fluorescent layer is not present. In an alternative system, the adhesive layer is not present. In an alternative system, the inverter power system is replaced by another source of alternating current.

The flexible panel system may further include a battery and a solar charging system for charging the battery, wherein the battery is arranged to power the inverter power system. An advantage is use in low maintenance situations, e.g. no human intervention is required over prolonged periods.

The flexible panel system may be one wherein the inverter power system is configured to make the electroluminescent panel layer flash e.g. at 1 Hz, or at 1.0 Hz, or at a frequency in the range of 0.5 Hz to 2 Hz, or at a frequency in the range of 0.2 Hz to 5 Hz, or at a frequency in the range of 0.1 Hz to 10 Hz. An advantage is improved safety e.g. in road safety applications.

The flexible panel system may be one wherein the inverter power system is adjustable so as to provide an adjustable flashing rate of the electroluminescent panel. An advantage is customizable improved safety e.g. in road safety applications.

The flexible panel system may be one wherein the inverter power system is arranged to drive a minimum load area of 7000 $cm^2$, or a maximum load area of 10000 $cm^2$, or a load area in the range from 7000 $cm^2$ to 10000 $cm^2$, or a load area in the range from 3000 $cm^2$ to 40000 $cm^2$. An advantage is applications on vehicular surfaces.

The flexible panel system may be one including a remote control, wherein the flexible panel system is configured such that the remote control is operable to turn on the electroluminescent panel layer, and is operable to turn off the electroluminescent panel layer. An advantage is improved safety e.g. in road safety applications.

The flexible panel system may be one including a flexible panel of any aspect according to the first aspect of the invention.

According to a third aspect of the invention, there is provided an object including a flexible panel system of any aspect of the second aspect of the invention, wherein the flexible panel is attached to an exterior surface of the object.

The object may be a vehicle, a van, a car, a truck, a bus, a traffic patrol vehicle, a tram, an automobile, an excavator (e.g. a JCB), a digger vehicle, a loader vehicle, a ship, a lifeboat, an oil tanker, a dock for a ship, a user platform for public transportation, a petrol (gasoline) tanker vehicle, a vehicle for transportation of hazardous materials, a skip (large transportable container for building or other refuse), scaffolding, a road traffic cone, a road sign, a crane, a train, an aeroplane, an aeroplane loading vehicle, a mobile staircase for an aeroplane, an airport terminal connector, a heavy goods vehicle's loading stairs, a vehicle that pushes or tows aeroplanes, a roadsweeping vehicle, a refuse (trash) collection vehicle, a dust cart, an ambulance, a fire engine (a fire truck), a motorbike or a police car.

The object may be a vehicle, wherein the flexible panel system is configured such that the electroluminescent panel layer will only illuminate if a vehicle handbrake is on. An advantage is improved safety e.g. in road safety applications.

According to a fourth aspect of the invention, there is provided a flexible panel system, the system including a plurality of flexible panels and an inverter power system, wherein the plurality of flexible panels are in connection with the inverter power system, each flexible panel, including (i) a fluorescent layer;

(ii) an electroluminescent panel layer arranged to illuminate the fluorescent layer;

(iii) an ultraviolet protection layer, transparent to visible light, arranged on a front face of the flexible panel to protect the fluorescent layer, and (iv) an adhesive layer;

wherein the adhesive layer is arranged on a rear face of the flexible panel, such that the flexible panel is attachable to a surface.

An advantage is that the flexible panels can conform to the shape of a non-flat surface (e.g. cylindrically curved) on which they are mounted, because of their flexibility. An advantage is that the flexible panels can conform to a range of shapes of non-flat surfaces on which they may be mounted, because of their flexibility. An advantage is that particular light emission colours can be provided from the flexible panels, through selection of the fluorescent layers. An advantage is that the layers below the ultraviolet protection layer are protected from ultraviolet radiation (e.g. solar ultraviolet radiation present outdoors during the day). An advantage is that the system can be used in applications on vehicular surfaces.

In an alternative system, the fluorescent layer is not present. In an alternative system, the adhesive layer is not present. In an alternative system, the inverter power system is replaced by another source of alternating current.

The flexible panel system may be one wherein the inverter power system is configured to make the electroluminescent panel layer flash e.g. at 1 Hz, or at 1.0 Hz, or at a frequency in the range of 0.5 Hz to 2 Hz, or at a frequency in the range of 0.2 Hz to 5 Hz, or at a frequency in the range of 0.1 Hz to 10 Hz.

The flexible panel system may be one wherein the inverter power system is adjustable so as to provide an adjustable flashing rate of the electroluminescent panel.

The flexible panel system may be one wherein the inverter power system is arranged to drive a minimum load area of 7000 $cm^2$, or a maximum load area of 10000 $cm^2$, or a load area in the range from 7000 $cm^2$ to 10000 $cm^2$, or a load area in the range from 3000 $cm^2$ to 40000 $cm^2$.

The flexible panel system may be one wherein the plurality of panels includes a left panel and a right panel. An advantage is ready application on van doors.

The flexible panel system may be one wherein the flexible panels of the flexible panel system are flexible panels of any aspect according to the first aspect of the invention.

According to a fifth aspect of the invention, there is provided an object including a flexible panel system of any aspect of the fourth aspect of the invention, wherein the flexible panels are attached to respective exterior surfaces of the object.

The object may be a vehicle, a van, a car, a truck, a bus, a traffic patrol vehicle, a tram, an automobile, an excavator (e.g. a JCB), a digger vehicle, a loader vehicle, a ship, a lifeboat, an oil tanker, a dock for a ship, a user platform for public transportation, a petrol (gasoline) tanker vehicle, a vehicle for transportation of hazardous materials, a skip (large transportable container for building or other refuse), scaffolding, a road traffic cone, a road sign, a crane, a train, an aeroplane, an aeroplane loading vehicle, a mobile staircase for an aeroplane, an airport terminal connector, a heavy goods vehicle's loading stairs, a vehicle that pushes or tows aeroplanes, a roadsweeping vehicle, a refuse (trash) collection vehicle, a dust cart, an ambulance, a fire engine (a fire truck), a motorbike or a police car.

According to a sixth aspect of the invention, there is provided a system including a flexible panel including electrical connectors, a flexible conductive ribbon in connection with the electrical connectors, and an inverter power system, wherein the flexible conductive ribbon is in connection with the inverter power system, the flexible panel including:

(i) a fluorescent layer;

(ii) an electroluminescent panel layer arranged to illuminate the fluorescent layer;

(iii) an ultraviolet protection layer, transparent to visible light, arranged on a front face of the flexible panel to protect the fluorescent layer, and (iv) an adhesive layer;

wherein the adhesive layer is arranged on a rear face of the flexible panel, such that the flexible panel is attachable to a surface.

An advantage is that the flexible panel can conform to the shape of a non-flat surface (e.g. cylindrically curved) on which it is mounted, because of its flexibility. An advantage is that the flexible panel can conform to a range of shapes of non-flat surfaces on which it may be mounted, because of its flexibility. An advantage is that a particular light emission colour can be provided from the flexible panel, through selection of the fluorescent layer. An advantage is that the layers below the ultraviolet protection layer are protected from ultraviolet radiation (e.g. solar ultraviolet radiation present outdoors during the day). An advantage is that the system can be used in applications on vehicular surfaces. An advantage is ease of retrofitting, e.g. in vehicular applications.

In an alternative system, the fluorescent layer is not present. In an alternative system, the adhesive layer is not present. In an alternative system, the inverter power system is replaced by another source of alternating current.

The system may be one wherein the inverter power system is configured to make the electroluminescent panel layer flash e.g. at 1 Hz, or at 1.0 Hz, or at a frequency in the range of 0.5 Hz to 2 Hz, or at a frequency in the range of 0.2 Hz to 5 Hz, or at a frequency in the range of 0.1 Hz to 10 Hz.

The system may be one wherein the inverter power system is adjustable so as to provide an adjustable flashing rate of the electroluminescent panel.

The system may be one wherein the inverter power system is arranged to drive a minimum load area of 7000 $cm^2$, or a maximum load area of 10000 $cm^2$, or a load area in the range from 7000 $cm^2$ to 10000 $cm^2$, or a load area in the range from 3000 $cm^2$ to 40000 $cm^2$.

The system may be one in which the flexible panel system includes a flexible panel of any aspect of the first aspect of the invention.

According to a seventh aspect of the invention, there is provided an object including a system of any aspect of the sixth aspect of the invention, wherein the flexible panel is attached to an exterior surface of the object.

The object may be one wherein the object is a vehicle, a van, a car, a truck, a bus, a traffic patrol vehicle, a tram, an automobile, an excavator (e.g. a JCB), a digger vehicle, a loader vehicle, a ship, a lifeboat, an oil tanker, a dock for a ship, a user platform for public transportation, a petrol (gasoline) tanker vehicle, a vehicle for transportation of hazardous materials, a skip (large transportable container for building or other refuse), scaffolding, a road traffic cone, a road sign, a crane, a train, an aeroplane, an aeroplane loading vehicle, a mobile staircase for an aeroplane, an airport terminal connector, a heavy goods vehicle's loading stairs, a vehicle that pushes or tows aeroplanes, a roadsweeping vehicle, a refuse (trash) collection vehicle, a dust cart, an ambulance, a fire engine (a fire truck), a motorbike or a police car.

According to an eighth aspect of the invention, there is provided a system including a plurality of flexible panels, each flexible panel including electrical connectors, and a flexible conductive ribbon in connection with the electrical connectors, wherein the system includes an inverter power system, wherein the plurality of flexible conductive ribbons are in connection with the inverter power system, each flexible panel including:

(i) a fluorescent layer;

(ii) an electroluminescent panel layer arranged to illuminate the fluorescent layer;

(iii) an ultraviolet protection layer, transparent to visible light, arranged on a front face of the flexible panel to protect the fluorescent layer, and (iv) an adhesive layer;

wherein the adhesive layer is arranged on a rear face of the flexible panel, such that the flexible panel is attachable to a surface.

In an alternative system, the fluorescent layer is not present. In an alternative system, the adhesive layer is not present. In an alternative system, the inverter power system is replaced by another source of alternating current.

An advantage is that the flexible panels can conform to the shape of a non-flat surface (e.g. cylindrically curved) on which they are mounted, because of their flexibility. An advantage is that the flexible panels can conform to a range of shapes of non-flat surfaces on which they may be mounted, because of their flexibility. An advantage is that particular light emission colours can be provided from the flexible panels, through selection of the fluorescent layers. An advantage is that the layers below the ultraviolet protection layer are protected from ultraviolet radiation (e.g. solar ultraviolet radiation present outdoors during the day). An advantage is that the system can be used in applications on vehicular surfaces. An advantage is ease of retrofitting, e.g. in vehicular applications.

The system may be one wherein the inverter power system is configured to make the electroluminescent panel layers flash e.g. at 1 Hz, or at 1.0 Hz, or at a frequency in the range of 0.5 Hz to 2 Hz, or at a frequency in the range of 0.2 Hz to 5 Hz, or at a frequency in the range of 0.1 Hz to 10 Hz.

The system may be one wherein the inverter power system is adjustable so as to provide an adjustable flashing rate of the electroluminescent panel layers.

The system may be one wherein the inverter power system is arranged to drive a minimum load area of 7000 $cm^2$, or a maximum load area of 10000 $cm^2$, or a load area in the range from 7000 $cm^2$ to 10000 $cm^2$, or a load area in the range from 3000 $cm^2$ to 40000 $cm^2$.

The system may be one wherein the flexible panels of the flexible panel system are flexible panels of any aspect according to the first aspect of the invention.

According to a ninth aspect of the invention, there is provided an object including a system of any aspect of the eighth aspect of the invention, wherein the flexible panels are attached to respective exterior surfaces of the object.

The object may be a vehicle, a van, a car, a truck, a bus, a traffic patrol vehicle, a tram, an automobile, an excavator (e.g. a JCB), a digger vehicle, a loader vehicle, a ship, a lifeboat, an oil tanker, a dock for a ship, a user platform for public transportation, a petrol (gasoline) tanker vehicle, a vehicle for transportation of hazardous materials, a skip (large transportable container for building or other refuse), scaffolding, a road traffic cone, a road sign, a crane, a train, an aeroplane, an aeroplane loading vehicle, a mobile staircase for an aeroplane, an airport terminal connector, a heavy goods vehicle's loading stairs, a vehicle that pushes or tows aeroplanes, a roadsweeping vehicle, a refuse (trash) collection vehicle, a dust cart, an ambulance, a fire engine (a fire truck), a motorbike or a police car.

According to a tenth aspect of the invention, there is provided a kit of parts including a flexible panel, wiring including a connector for connection to electrical connectors of the flexible panel and for connection to an inverter power supply, the kit of parts including an inverter power supply for connection to a vehicle power source (e.g. a vehicle battery).

According to an eleventh aspect of the invention, there is provided a kit of parts including an electroluminescent panel, a fluorescent sheet (e.g. yellow), an ultraviolet protection laminate which is transparent to visible light, retroreflective sheet parts (e.g. red), an adhesive sheet, a connector including a tail, and an inverter power system.

According to a twelfth aspect of the invention, there is provided a kit of parts including a plurality of flexible panels (e.g. a nearside flexible panel and an offside flexible panel), each flexible panel including (i) a fluorescent layer;

(ii) an electroluminescent panel layer arranged to illuminate the fluorescent layer;

(iii) an ultraviolet protection layer, transparent to visible light, arranged on a front face of the flexible panel to protect the fluorescent layer, and (iv) an adhesive layer;

wherein the adhesive layer is arranged on a rear face of the flexible panel, such that the flexible panel is attachable to a surface;

a respective connector-plus-tail assembly corresponding to each respective flexible panel;

and an inverter simultaneously connectable to all the respective connector-plus-tail assemblies.

The kit of parts may be one wherein the plurality of flexible panels comprise a nearside flexible panel and an offside flexible panel.

The kit of parts may be one wherein the plurality of flexible panels comprise a nearside top flexible panel, a nearside bottom flexible panel, an offside top flexible panel, and an offside bottom flexible panel.

According to a thirteenth aspect of the invention, there is provided a system including a flexible panel, the flexible panel including (i) a fluorescent layer;

(ii) an electroluminescent panel layer arranged to illuminate the fluorescent layer;

(iii) an ultraviolet protection layer, transparent to visible light, arranged on a front face of the flexible panel to protect the fluorescent layer, and (iv) a magnetic mounting layer;

wherein the magnetic mounting layer is arranged on a rear face of the flexible panel, such that the flexible panel is attachable to a surface, the system optionally further including an inverter, and a connector for connecting the inverter to a vehicle cigarette light adapter.

An advantage is suitability for use in vehicle breakdown applications.

According to a fourteenth aspect of the invention, there is provided a computer-aided design (CAD) file storing a two dimensional shape of a flexible panel, the two dimensional shape including one or more slits to enable the flexible panel to conform to a shape of a vehicle, when mounted on the vehicle. An advantage is that the CAD file can be used for shaping during manufacture of the various layers of a flexible panel, such as a flexible panel according to any aspect according to a first aspect of the invention.

According to a fifteenth aspect of the invention, there is provided a flexible physical guide or template, the flexible physical guide or template providing a two dimensional shape of a flexible panel, the two dimensional shape including one or more slits to enable the flexible panel to conform to a shape of a vehicle, when mounted on the vehicle. An advantage is that the flexible physical guide or template can be used to check that a proposed two dimensional shape of a flexible panel, such as a flexible panel according to any aspect according to a first aspect of the invention, really does conform to the shape of a vehicle when mounted on the vehicle.

According to a sixteenth aspect of the invention, there is provided a method of assembly of a flexible panel, the method including the steps of (a) installing a fluorescent (e.g. vinyl) sheet (e.g. yellow) onto an EL panel;

(b) installing a UV laminate onto the combined fluorescent sheet and EL panel;

(c) wrapping the UV laminate over edges of the combined fluorescent sheet and EL panel so as to reach onto a back side of the combined fluorescent sheet and EL panel; and (d) installing retroreflective sheet material (e.g. red) (e.g. chevrons) onto the UV laminate.

According to a seventeenth aspect of the invention, there is provided a method of connecting electrically a flexible panel to a power supply situated within a vehicle, the flexible panel including a connector-plus-tail assembly, the flexible panel including:

(i) a fluorescent layer;

(ii) an electroluminescent panel layer arranged to illuminate the fluorescent layer;

(iii) an ultraviolet protection layer, transparent to visible light, arranged on a front face of the flexible panel to protect the fluorescent layer, and (iv) an adhesive layer;

the method including the steps of (a) removing an item mounted on the exterior of the vehicle from the vehicle;

(b) feeding a tail of the connector-plus-tail assembly through a hole of a body of the vehicle, behind where the item is normally mounted, from outside the vehicle, into a vehicle interior;

(c) connecting the tail within the vehicle to a lead which is in connection with an inverter power supply within the vehicle, and (d) reinstalling the item onto the vehicle, to cover the hole used to feed through the tail from outside the vehicle, into the vehicle interior.

An advantage is retrofitting the flexible panel in a vehicle application.

The method may be one wherein the item is plastic bumper trims, a vehicle logo badge or a number plate light holder, or a plug.

According to an eighteenth aspect of the invention, there is provided a flexible power connector and tail assembly. An advantage is reliable power connectability between a flexible panel mounted on a vehicle, and a power system within the vehicle.

The flexible power connector and tail assembly may be one including a flexible power connector, a tail and a tail connector. An advantage is ease of power connectability between a flexible panel mounted on a vehicle, and a power system within the vehicle.

The flexible power connector and tail assembly may be one wherein the flexible power connector is a flat printed circuit cable (FPC) connector e.g. a polyimide flat printed circuit cable (FPC) connector. An advantage is reliable power connectability between a flexible panel mounted on a vehicle, and a power system within the vehicle.

The flexible power connector and tail assembly may be one wherein the tail thickness is in the range of 50 microns to 500 microns, or the tail thickness is in the range of 100 microns to 300 microns. An advantage is ease of power connectability between a flexible panel mounted on a vehicle, and a power system within the vehicle.

The flexible power connector and tail assembly may be one wherein the tail includes a conducting metal layer in the range of 20 microns to 60 microns in thickness, surrounded by a flexible insulating layer in the range from 15 microns to 50 microns thick. An advantage is ease of power connectability between a flexible panel mounted on a vehicle, and a power system within the vehicle.

The flexible power connector and tail assembly may be one wherein the tail includes a conducting metal layer e.g. which includes copper. An advantage is reduced Joule heating.

The flexible power connector and tail assembly may be one wherein the tail includes a flexible insulating layer e.g. which includes polyimide. An advantage is ease of power connectability between a flexible panel mounted on a vehicle, and a power system within the vehicle.

The flexible power connector and tail assembly may be one wherein the tail has a width in the range from 3 mm to 10 mm, or in the range from 3 mm to 30 mm. An advantage is ease of power connectability between a flexible panel mounted on a vehicle, and a power system within the vehicle.

The flexible power connector and tail assembly may be one wherein the tail is a ribbon cable. An advantage is ease of power connectability between a flexible panel mounted on a vehicle, and a power system within the vehicle.

Aspects of the invention may be combined.

BRIEF DESCRIPTION OF THE FIGURES

Aspects of the invention will now be described, by way of example(s), with reference to the following Figures, in which:

In FIG. 17A, dimensions are in mm.

DETAILED DESCRIPTION

In an example, there has been designed and developed an illuminated chevron panel that can be installed to (e.g. van, e.g. Ford van, e.g. Ford model no. 363 van) vehicles, for example to replace traditional reflective chevron kits. An objective of the panel product, when installed on a vehicle, is to significantly increase the safety of users (e.g. road and pedestrian users, or road workforce members or vehicle workforce members), by enhancing the visibility of the vehicle in low levels of ambient light.

Under the current UK government guidelines, and in some other countries, every vehicle that undertakes stationary works on a road with a speed limit of 50 mph (80 kph) or more, must be fitted with High Visibility Markings. Whilst the (so-called "Chapter 8") Chevron Kits that are currently on the market are effective during daylight hours, their effectiveness decreases as the ambient light level decreases. By using a flat light source panel and using it to illuminate a yellow fluorescent material covered with retro-reflective red strips, the red strips being no less than 150 mm apart with an incline of between 45-60°, a panel product will comply to UK Chapter 8 guidelines whilst being able to be seen 24 hours a day from a greater distance than unlit panels can be seen from at night or in dim lighting conditions. An example of a retroreflective sheet (e.g. red) is Diamond Grade DG3 Reflective Sheeting manufactured by 3M UK TRADING LIMITED, 3 m Centre Cain Road, Bracknell, Berkshire, UK. In an alternative, a white fluorescent material may be used, to provide red and white chevrons. In an alternative, a fluorescent material providing a first colour may be used, and retro-reflective strips of a second colour may be used to provide chevrons of the first colour and of the second colour.

Figure 1:
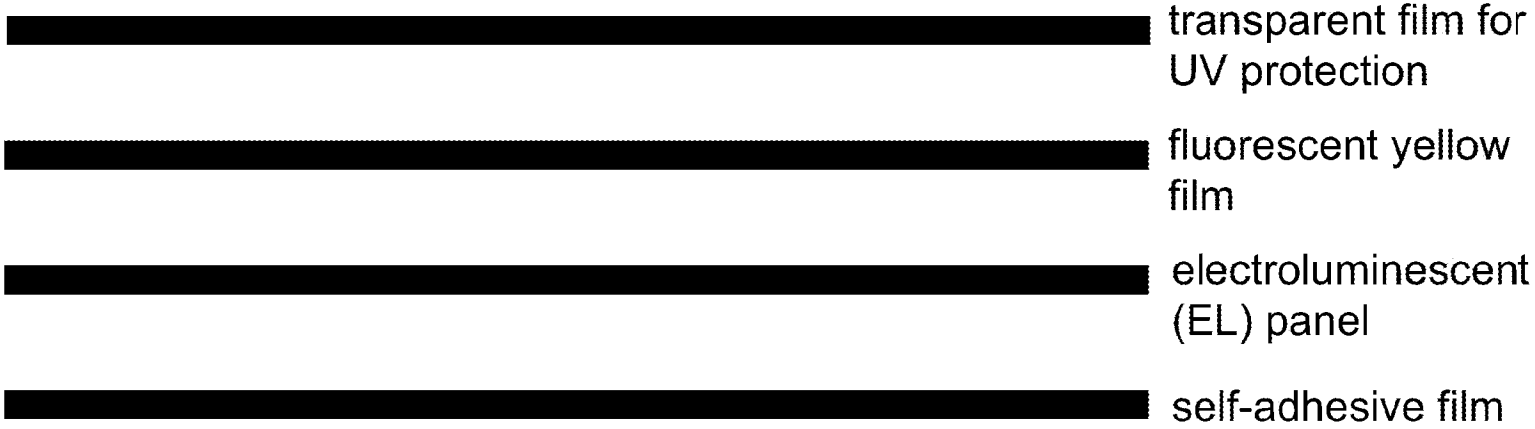
FIG. 1 shows an example of electroluminescent (EL) panel layers.

In an example, the panel includes four individual layers of material: a transparent film to protect the rest of the panel from ultraviolet (UV) light, a fluorescent yellow film, an electroluminescent (EL) panel and a self-adhesive film. An example of panel layers is shown in FIG. 1. An example of a transparent film for UV protection is UV-700 manufactured by Metamark (UK) Limited, of Lancaster, UK. An example of a fluorescent yellow film is ORACAL 7510 manufactured by ORAFOL Europe GmbH, Oranienburg, Germany (other colours are also possible, e.g. orange fluorescent, red orange fluorescent, orange red fluorescent, red fluorescent, pink fluorescent, and green fluorescent). Use of a white fluorescent film is also possible. The panel is sealed to prevent water (e.g. rain water) ingress.

A ceramic coating may be applied to the transparent film for UV protection, to provide further resistance against abrasion and to make it easier to wash off dirt.

An example of a ceramic coating which may be applied to the transparent film for UV protection, to provide further resistance against abrasion and to make it easier to wash off dirt, is the product Clear Coat manufactured by Aqueous Guard, Sittingbourne, Kent, UK. Clear Coat is a coating solution that can protect smooth, non-absorbent surfaces against for example graffiti, salt spray, diesel and acid rain staining. Clear Coat forms a permanent barrier layer that bonds chemically with the substrate, curing at room temperature and atmospheric humidity. The surface protected with Clear Coat can be cleaned repeatedly without degrading the coating. The coating is UV stable. Before curing, the appearance is as a clear colourless liquid. The binder base is organic silane and $SiO_2$. The solvent base is low in VOCs (volatile organic compounds). The thickness of the coating when cured is up to 13 μm, in an example. The coating may be applied using rolling and tip methods. The hardness of the cured film is up to 9H (Mohs hardness). The film is typically applied with a single coat.

An example of a ceramic coating which may be applied to the transparent film for UV protection, to provide further resistance against abrasion and to make it easier to wash off dirt, is the product Plus+ manufactured by Aqueous Guard, Sittingbourne, Kent, UK.

Plus+ is an antimicrobial ceramic coating that incorporates Biomaster's antimicrobial silver additive providing the same benefits of Clear Coat but with added benefit of reducing bacterial levels on the surface, offering product protection. Biomaster antimicrobial technology complements regular cleaning regimes; offering round-the-clock product protection against harmful bacteria and mould, reducing bacteria levels by up to 99.9%. Plus+ Biomaster has three modes of action. When bacteria lands on a Plus+ protected surface, they are prevented from growing, producing energy or replicating, therefore they die. Plus+ Biomaster is incredibly durable and highly effective. Tested in thousands of applications, Biomaster is proven to reduce the overall level of most common types of harmful pathogens on product surfaces. In typical tests to ISO 22196:2011 Biomaster reduced levels of *E. coli*, MRSA, *Listeria, Legionella, Salmonella, Campylobacter* and *Staphylococcus aureus* by over 99%. The coating is UV stable. Before curing, the appearance is as a clear colourless liquid. The binder base is organic silane and $SiO_2$. The solvent base is low in VOCs (volatile organic compounds). The thickness of the coating when cured is up to 13 μm, in an example. The coating may be applied using rolling or using a tip, or hand applied. The hardness of the cured film is up to 9H (Mohs hardness). The film is typically applied with a single coat, but multiple coats may be applied, if hand applied.

The panel includes an electroluminescent (EL) panel: this is the source of the light. In an example, light is typically emitted due to layers of conductive and non-conductive plastic and a layer of phosphor, in the EL panel. The phosphor is laminated between two conductive layers. As a voltage is applied between the two conductive layers, or electrodes, the phosphor emits light energy.

During assembly of the panel, in an example, the edges of the transparent film for UV protection (e.g. UV-700) are wrapped around the edges of the panel, before the self-adhesive film is applied. An advantage is that this helps to protect the edges of the panel from UV light. An advantage is that this helps to seal the panel against water ingress.

On the rear of the EL panel a self-adhesive material is applied. This enables the panel to be securely installed onto the vehicle. On top of the EL panel a fluorescent yellow film is applied: this provides compliance with current UK government guidelines, in terms of the chevron colour. Lastly a transparent UV protective material is applied and wrapped around the edges of the whole panel; this material not only protects the panel from discolouring due to UV rays (e.g. from sunlight) but increases the resistance to abrasion and provides durability of the fluorescent yellow film and of the EL panel.

The retro reflective red strips are fitted last and for example may be either fitted at the point of manufacturing or out in the field, for example if the panel is to be incorporated into an existing chevron design.

In an example, on the reverse of the panel are two (e.g copper) (e.g. highly flattened) connectors that make up part of the cabling system that is present for these panels (e.g. for a Ford van). In an example, it is paramount that the panel is fitted as flush as possible to the body of the vehicle, so in an example a flat conductive ribbon was created to provide the power to the (e.g. highly flattened) connectors. To provide power, the cabling (e.g. flat conductive ribbons) of the panels is wired (e.g. hard wired) into a power supply (e.g. an inverter that changes direct current (DC) to alternating current (AC)) that is connected to the vehicle electrical power system.

Regarding power, an inverter may be provided, which is used to power the EL panel, based on power input from a vehicle power system, such as a vehicle battery, which may for example may be a 12V or 24V vehicle battery. EL panels typically require voltages in excess of 12V or 24V, such as voltages in the range of 60 V to 600 V. Hence typically a vehicle battery cannot be used directly to power an EL panel.

Figure 2:
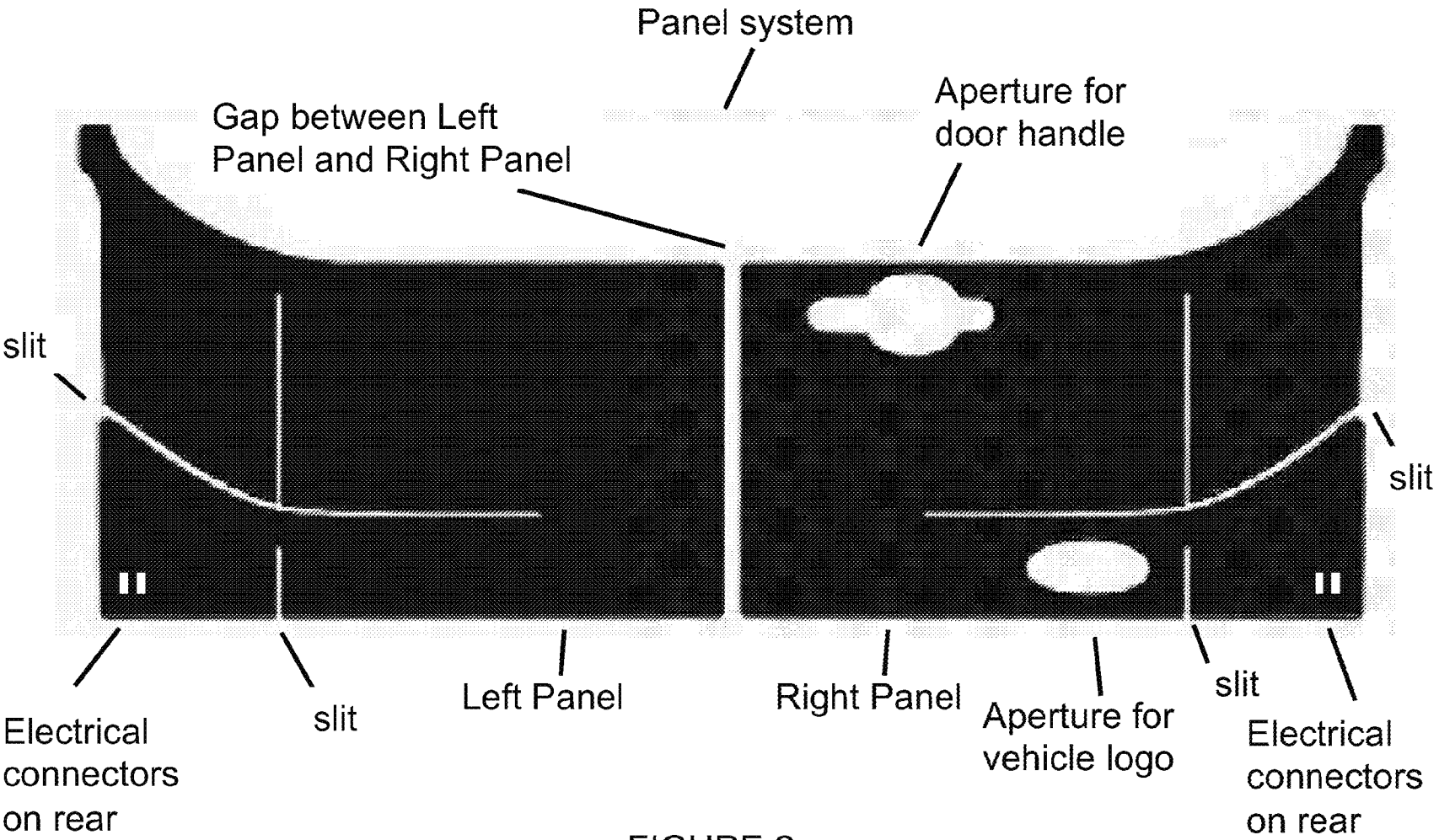
FIG. 2 shows an example of an electroluminescent (EL) panel system.

In an example, an illuminated panel system for installing on a vehicle is shaped for a specific application. A panel system may include a single panel or a plurality of panels (for example two panels, for example a left panel and a right panel, which may be for use on respective rear left and rear right doors of a van). Each panel of a panel system may include its own pair of electrical connectors, which are typically on the reverse side of the panel, for connection to a power supply, in connection with a vehicle power system. A panel of the panel system may include an aperture e.g. for a vehicle door handle. An advantage is that the door can still be opened, even if a panel is attached to a rear of a van. A panel of the panel system may include an aperture e.g. for a vehicle logo or badge. An advantage is that wiring from the panel which passes into the vehicle through an aperture behind the vehicle logo or badge can be checked, without removing the entire panel. The panel system may include panel slits which are adapted to enable the panel, when affixed to a vehicle, to conform to a curved shape of the vehicle, such as a curved shape of a rear of a van. An example of a panel system is shown in FIG. 2.

The local curvature on a vehicle surface may be that of a convex cylinder. The panel system may include panel slits which are adapted to enable the panel, when affixed to a vehicle, to conform to a locally curved convex cylinder shape of the vehicle, e.g. using a single slit, to accommodate the curvature.

The local curvature on a vehicle surface may be that of a convex ellipsoid (or a convex sphere). The panel system may include panel slits which are adapted to enable the panel, when affixed to a vehicle, to conform to a locally curved convex ellipsoid (or convex sphere) shape of the vehicle, e.g. using two slits, which may be arranged at right angles to each other, or at least substantially non-parallel to each other, to accommodate two (e.g. principal) curvatures of the surface.

The panel system may have a (e.g. maximum) operating temperature of 120° C. The panel system may have a (e.g. maximum) operating temperature of 70° C. The panel system may have a (e.g. minimum) operating temperature of −30° C. (minus 30 degrees C.).

Figure 3:
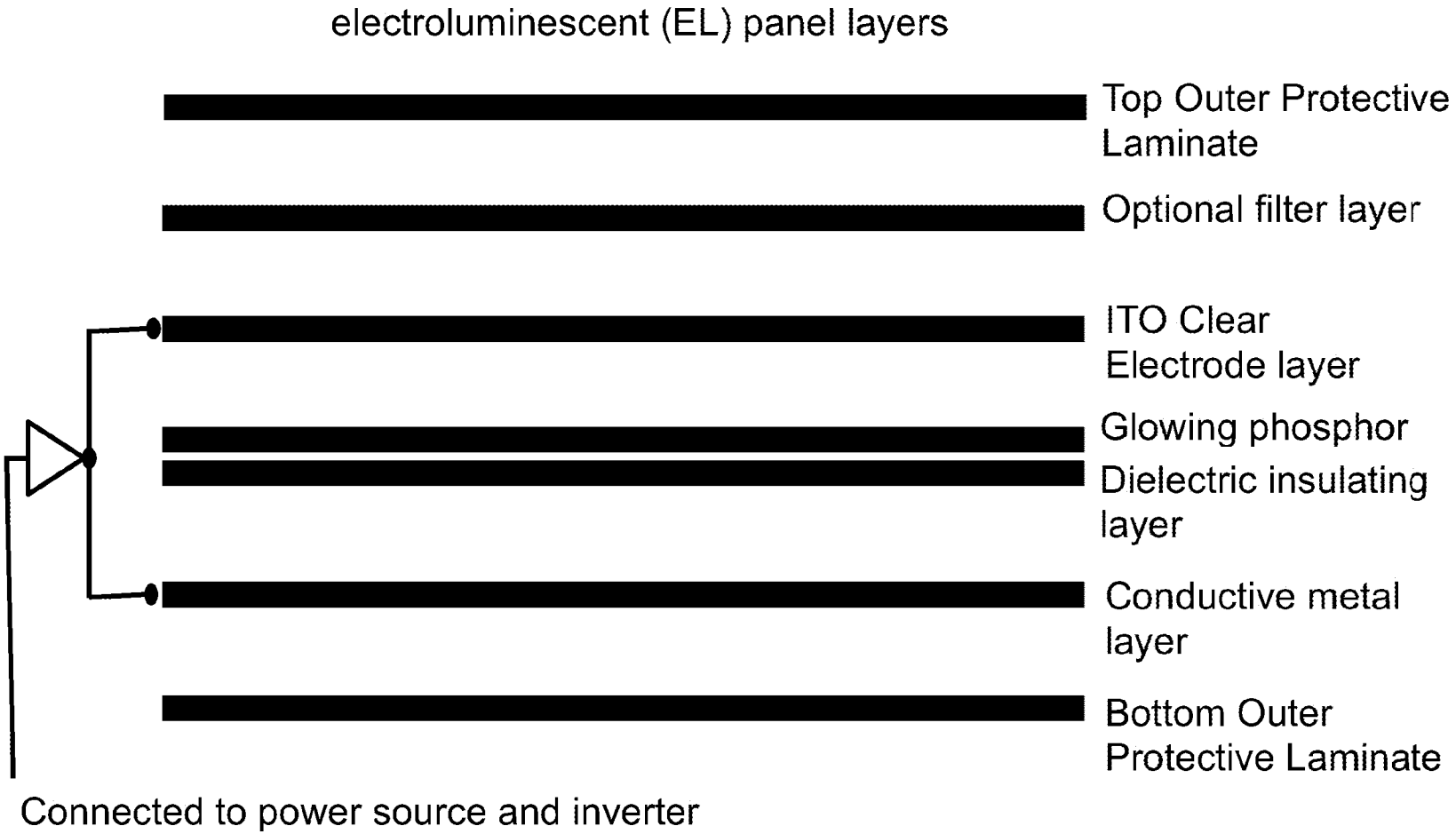
FIG. 3 shows an example of electroluminescent (EL) panel layers.

An electroluminescent panel may comprise the following structure. A top outer protective laminate is situated next to an optional filter layer, which is situated next to an ITO (indium tin oxide) clear electrode layer. The ITO layer sits above a glowing phosphor layer, which is above a dielectric insulating layer, which sits above a conductive metal layer. Below the conductive metal layer is a bottom outer protective laminate. The ITO clear electrode layer and the conductive metal layer are connected to a power source and inverter. An example of electroluminescent panel layers is shown in FIG. 3.

A panel system may be provided as a kit of parts. The panel system may comprise one or a plurality of panels, wiring with connectors for connection to electrical connectors of the one or the plurality of panels and for connection to a power supply, and a power supply for connection to a vehicle power source (e.g. a vehicle battery). The power supply may be an inverter, to change direct current (DC) to alternating current (AC).

A panel or the panels of a panel system may be flexible. A panel or the panels of a panel system may not have sufficient strength to be self-supporting. A panel or panels of a panel system may be capable of being curled such that the panel or panels each lies in a smooth continuous arcuate curve having a diameter of less than 1.0 m. A panel or panels of a panel system may be capable of being curled such that the panel or panels each lies in a smooth continuous arcuate curve having a diameter of less than 50 cm. A panel or panels of a panel system may be capable of being curled such that the panel or panels each lies in a smooth continuous arcuate curve having a diameter of less than 20 cm. An advantage of being curlable is that a panel can conform to a (e.g. curved) vehicle shape, when mounted on the vehicle.

A panel or the panels of a panel system may have a thickness in the range of 1 mm to 10 mm. A panel or the panels of a panel system may have a thickness in the range of 2 mm to 5 mm. A panel or the panels of a panel system may have a thickness in the range of 3 mm to 8 mm. A panel or the panels of a panel system may have a thickness in the range of 4 mm to 7 mm.

A panel or the panels of a panel system (e.g. when mounted) may have a width in the range of 1500 mm to 2100 mm. A panel or the panels of a panel system (e.g. when mounted) may have a width in the range of 1000 mm to 1400 mm. A panel or the panels of a panel system (e.g. when mounted) may have a width in the range of 1000 mm to 2100 mm.

A panel or the panels of a panel system (e.g. when mounted) may have a height in the range of 600 mm to 850 mm. A panel or the panels of a panel system (e.g. when mounted) may have a height in the range of 600 mm to 1300 mm. A panel or the panels of a panel system (e.g. when mounted) may have a height in the range of 600 mm to 2000 mm. A panel or the panels of a panel system (e.g. when mounted) may have a height in the range of 600 mm to 2800 mm. A panel or the panels of a panel system (e.g. when mounted) may have a height in the range of 200 mm to 400 mm. A panel or the panels of a panel system (e.g. when mounted) may have a height in the range of 200 mm to 2800 mm.

A panel or the panels of a panel system may provide a brightness in the range of 10 to 200 candela per $m^2$. A panel or the panels of a panel system may provide a brightness in the range of 50 to 200 candela per $m^2$. A panel or the panels of a panel system may provide a brightness in the range of 50 to 150 candela per $m^2$.

A panel or the panels of a panel system may have a weight per unit area in the range of from 0.1 to 1.0 $g/cm^2$. A panel or the panels of a panel system may have a weight per unit area in the range of from 0.3 to 0.8 $g/cm^2$. A panel or the panels of a panel system may have a weight per unit area in the range of from 0.5 to 0.7 $g/cm^2$.

Panel systems may be provided which are suited for affixing to various vehicles or items. A panel system may be provided for any of a van, a car, a truck, a bus, a traffic patrol vehicle, a tram, an automobile, an excavator (e.g. a JCB), a digger vehicle, a loader vehicle, a ship, a lifeboat, an oil tanker, a dock for a ship, a user platform for public transportation, a petrol (gasoline) tanker vehicle, a vehicle for transportation of hazardous materials, a skip (large transportable container for building or other refuse), scaffolding, a road traffic cone, a road sign, a crane, a train, an aeroplane, an aeroplane loading vehicle, a mobile staircase for an aeroplane, an airport terminal connector, a heavy goods vehicle's loading stairs, a vehicle that pushes or tows aeroplanes, a roadsweeping vehicle, a refuse (trash) collection vehicle, a dust cart, an ambulance, a fire engine (a fire truck), a motorbike or a police car.

A panel system may include a magnetic mounting layer (or one or more magnetic mounts) for affixing to a vehicle, e.g. for affixing to a vehicle temporarily. A magnetic mounting layer may be provided as an alternative to an adhesive layer. A panel system including an inverter may include a connector for connecting to a vehicle cigarette light adapter to provide power. In an example, a panel system includes a magnetic mounting layer for affixing to a vehicle (e.g. as an alternative to an adhesive layer), an inverter, and a connector for connecting to a vehicle cigarette light adapter to provide power, so that for example the panel can be used in a breakdown situation such that the panel can be magnetically affixed to a vehicle (e.g. to a rear of the vehicle), and provided with power, to reduce the risk of another vehicle colliding with the broken down vehicle, such as on a multi-lane highway.

A panel system may include a battery and a solar charging system for charging the battery: for example such a system may be used together with a skip, scaffolding, a road traffic cone, or a road sign. A panel system may be powered from a vehicle battery, or alternatively from a battery pack.

A power supply (e.g. an inverter) of a panel system may be configured to make an electroluminescent panel flash e.g. at 1 Hz, or at 1.0 Hz, or at a frequency in the range of 0.5 Hz to 2 Hz, or at a frequency in the range of 0.2 Hz to 5 Hz, or at a frequency in the range of 0.1 Hz to 10 Hz. The power supply (e.g. an inverter) may be adjustable so as to provide an adjustable flashing rate of the electroluminescent panel. The power supply (e.g. an inverter) may be adjustable so as to provide that the electroluminescent panel is permanently illuminated, and does not flash. The power supply (e.g. an inverter) may be adjustable so as to provide an adjustable luminance of the electroluminescent panel.

In an example, the function of the inverter is to provide true sine wave alternating current power to an electroluminescent panel system. An inverter for use with an electroluminescent panel system may receive a DC input voltage of 12 V (or a DC input voltage in the range from 9.1 V to 15 V) with a maximum DC current of 8.3 A (or a DC current in the range from 8 A to 11 A), at a maximum power of 100 W. An inverter for use with an electroluminescent panel system may output a minimum voltage of 80V. An inverter for use with an electroluminescent panel system may output a maximum voltage of 130V. An inverter for use with an electroluminescent panel system may output a voltage in the range of from 80 V to 130V; a preferred output voltage may be 115 V. An inverter for use with an electroluminescent panel system may output a minimum AC frequency of 600 Hz. An inverter for use with an electroluminescent panel system may output a maximum AC frequency of 1100 Hz. An inverter for use with an electroluminescent panel system may output an AC frequency in the range from 600 Hz to 1100 Hz, or in the range from 800 Hz to 1300 Hz; a preferred output frequency may be 900 Hz. An inverter for use with an electroluminescent panel system may output an AC frequency which is adjustable. An inverter for use with an electroluminescent panel system may drive a minimum load area of 7000 $cm^2$. An inverter for use with an electroluminescent panel system may drive a maximum load area of 10000 $cm^2$. An inverter for use with an electroluminescent panel system may drive a load area in the range from 7000 $cm^2$ to 10000 $cm^2$. An inverter for use with an electroluminescent panel system may drive a load area in the range from 3000 $cm^2$ to 40000 $cm^2$. An inverter for use with an electroluminescent panel system may have an operating temperature in the range from minus 10 deg C. to 50 deg C.

In an example, the function of the inverter is to provide true sine wave alternating current power to an electroluminescent panel system, e.g. to supply 115 V 900 Hz AC for an electroluminescent panel system. In an example, when the inverter supplies power (e.g. 115 V 900 Hz AC) to an electroluminescent panel system, there is no visible time variation of the brightness of the electroluminescent panel system for a human observer. Example outputs of the inverter are DC 12V (single wire), ground (single wire), output1 (single wire) and output2 (single wire). In an example, when installed within a vehicle, the normal user of the vehicle has no access to the inverter. In an example, when installed within a vehicle, the reference ground is connected directly to a chassis of the vehicle. In an example, the inverter includes a printed circuit board which has a direct DC connection to a metallic case of the inverter. An example inverter is the Model Flex—DC 10,0000 BKLF.

Figure 4:
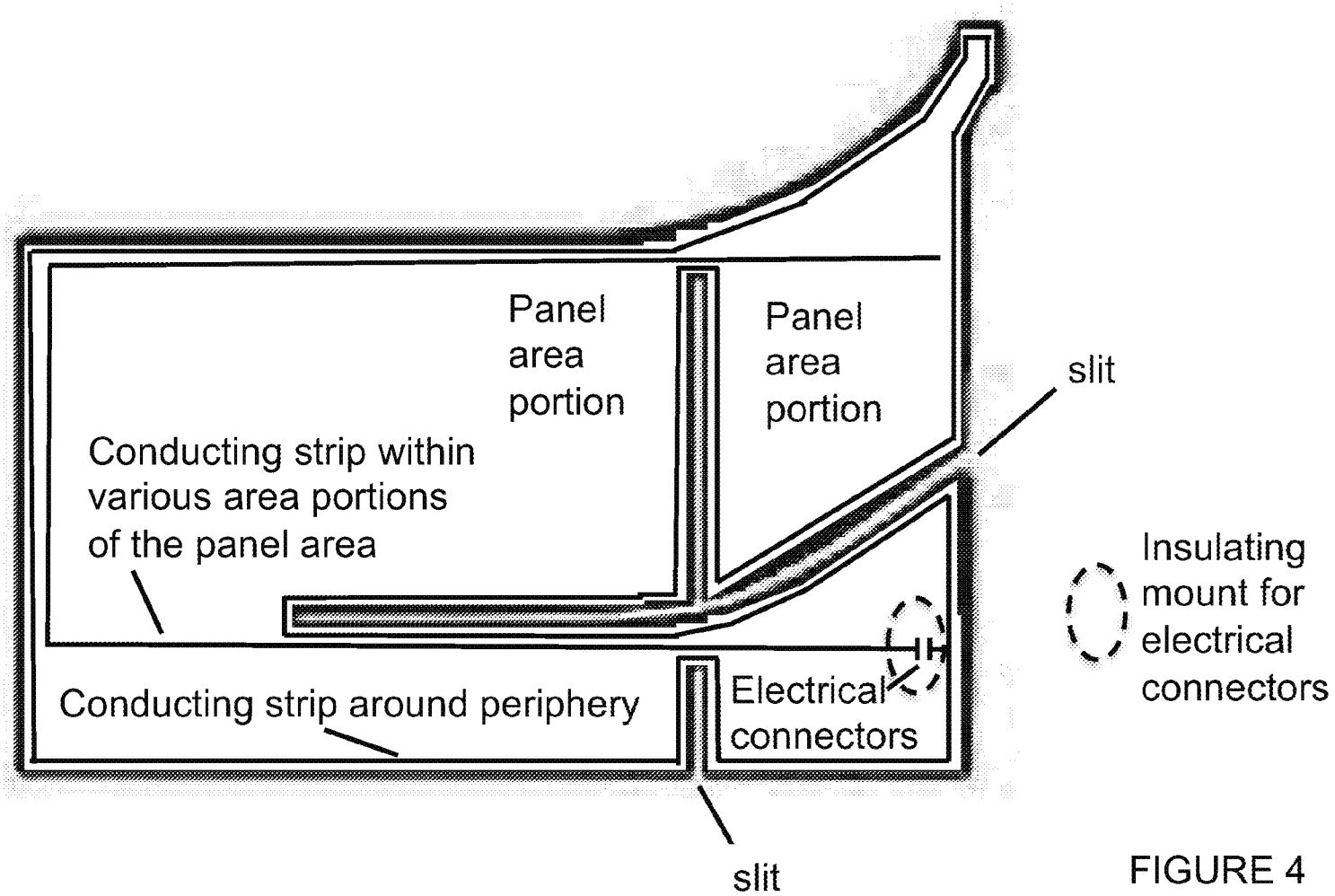
FIG. 4 shows an example of a rear of an electroluminescent (EL) panel.

In an example, the power supply supplies power to a pair of electrical connectors which are mounted on the rear of a panel. The pair of electrical connectors are mounted on an insulator. One of the connectors may be connected to a conducting (e.g. copper) strip or track which is situated around a periphery of the panel, e.g. which runs continuously around a periphery of the panel. The other connector may be connected to a conducting (e.g. copper) strip or track which is situated within the panel area, e.g. within various area portions of the panel area, such as area portions which are defined by slits in the panel. An example is shown in FIG. 4.

Before panel manufacturing, a guide may need to be made which defines the two dimensional shape of the panel, including any slits to enable the panel to conform to a vehicle shape (e.g. to curved surfaces of the vehicle, e.g. to compound corners of the vehicle) when the panel is mounted on the vehicle, so that the panel adheres well (e.g. adheres snugly, or adheres with conformity of shape) to the vehicle. After the guide has been made, the panel can be manufactured according to the two dimensional shape defined by the guide.

Figure 5:
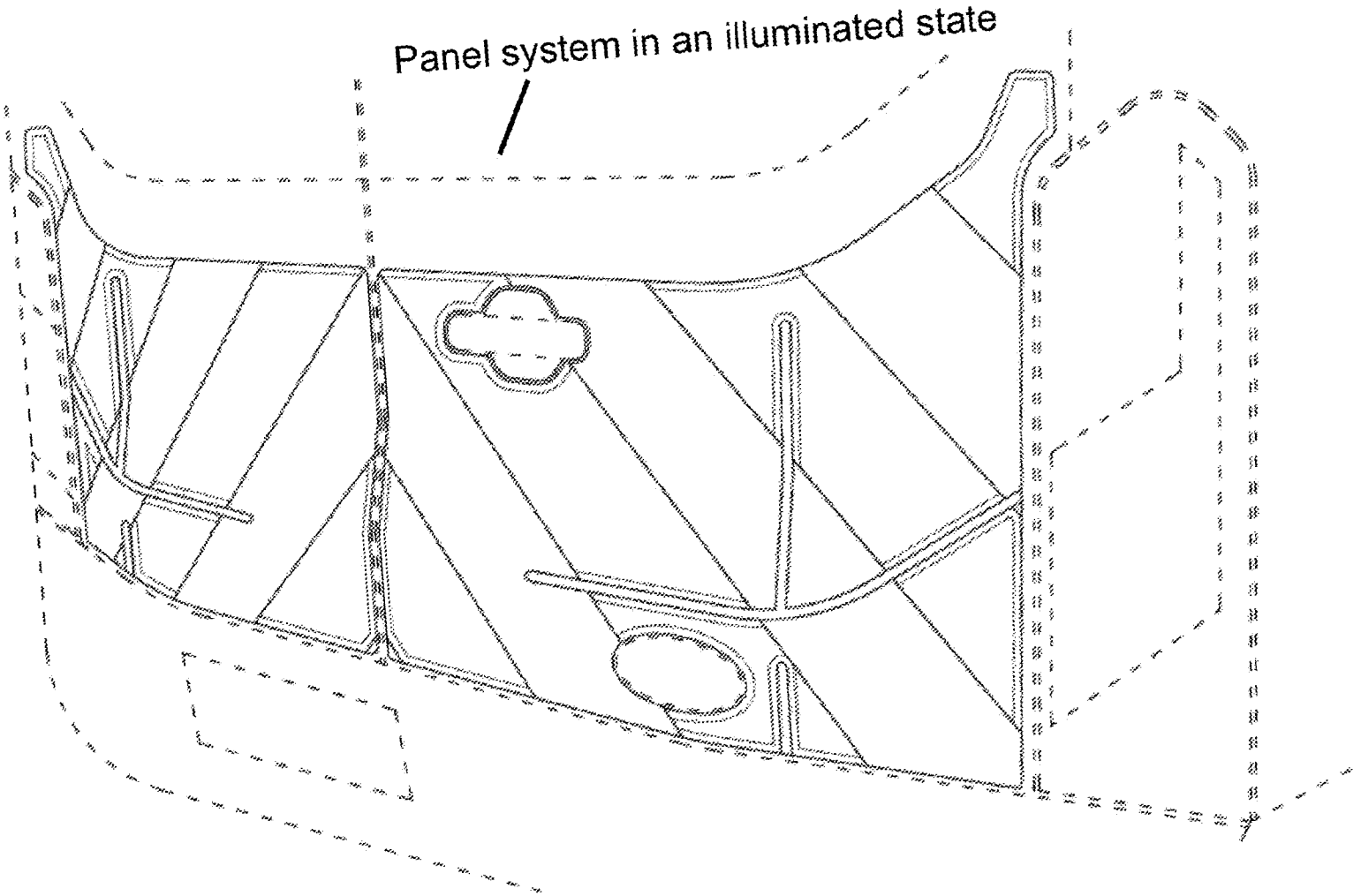
FIG. 5 shows a right perspective view of an example of an electroluminescent (EL) panel system in an illuminated state, when installed on a vehicle.
Figure 6:
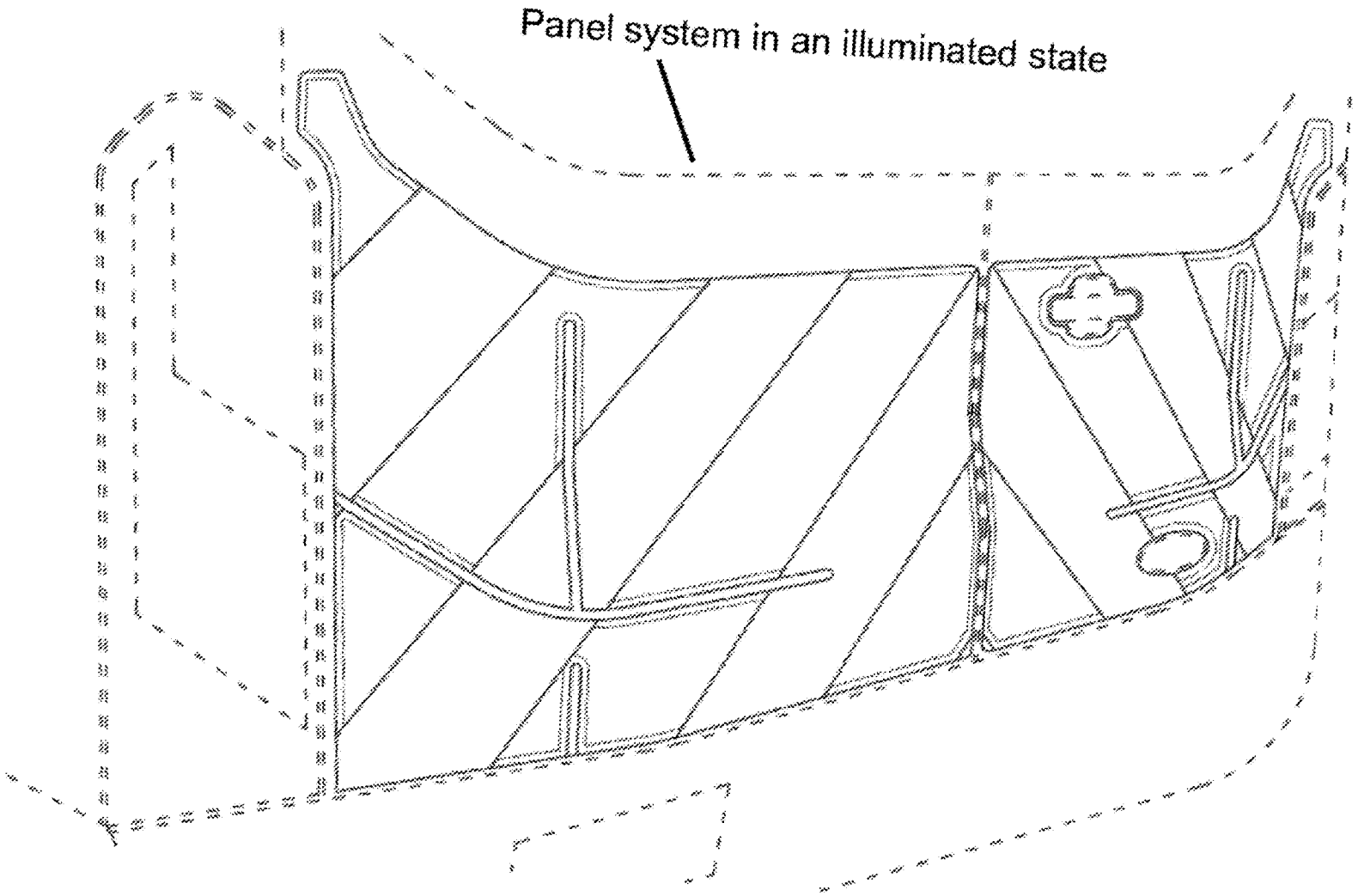
FIG. 6 shows a left perspective view of the example of an electroluminescent (EL) panel system in an illuminated state, when installed on a vehicle, shown in FIG. 5.
Figure 7:
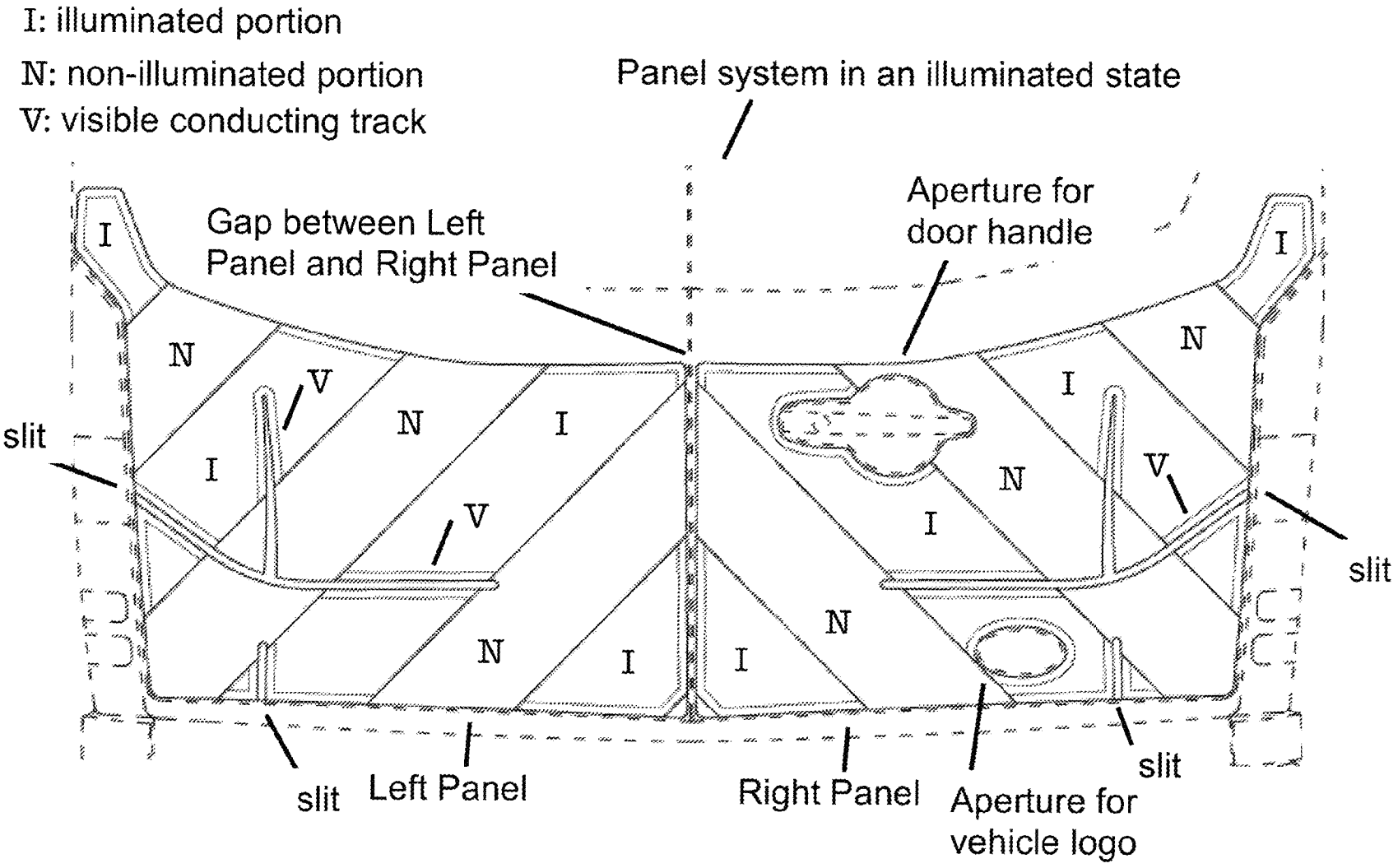
FIG. 7 shows a rear view of the example of an electroluminescent (EL) panel system in an illuminated state, when installed on a vehicle, shown in FIG. 5.
Figure 8:
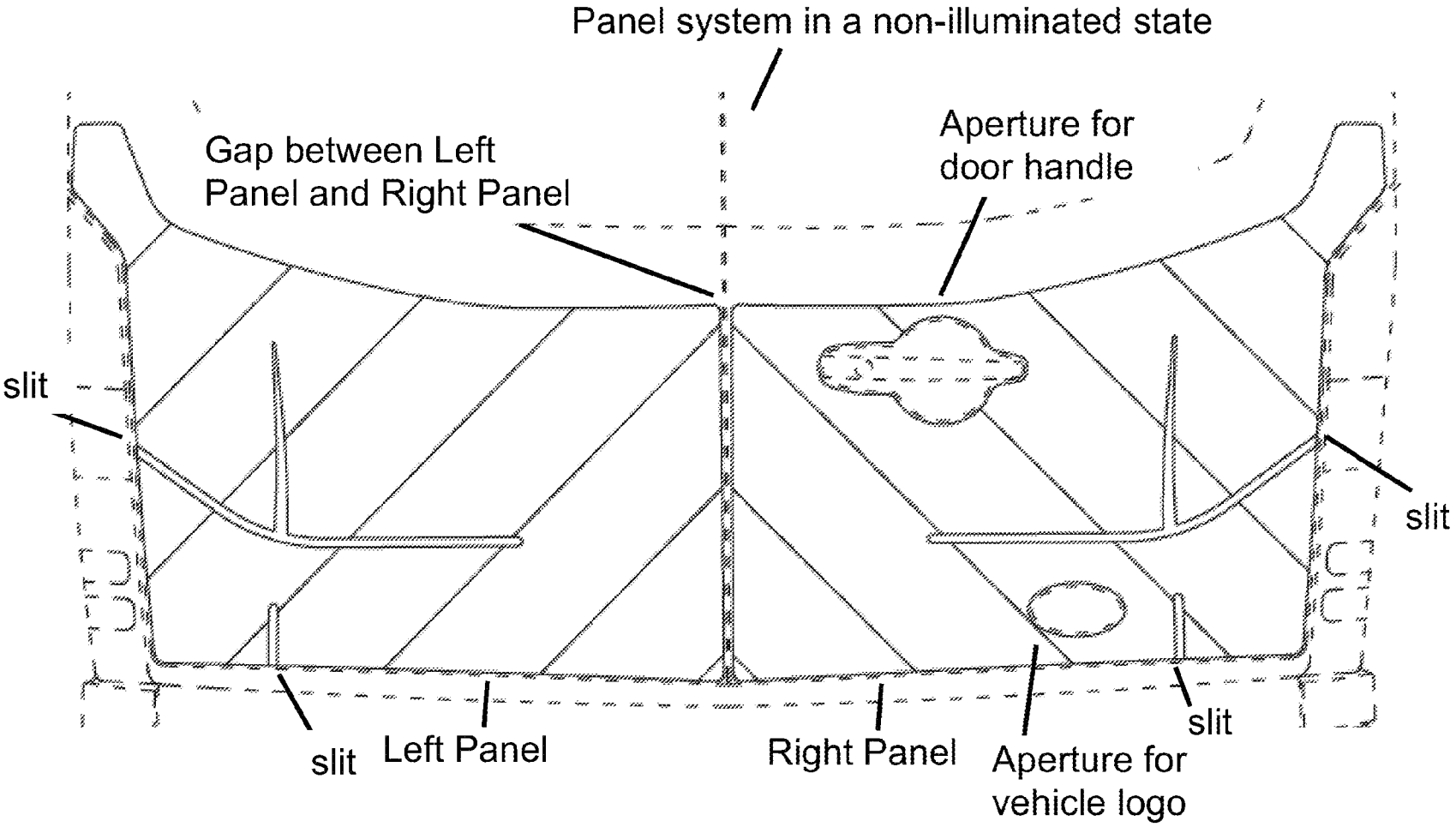
FIG. 8 shows a rear view of an example of an electroluminescent (EL) panel system in a non-illuminated state, when installed on a vehicle, corresponding to the example of an electroluminescent (EL) panel system in an illuminated state, when installed on a vehicle, shown in FIG. 7.

An electroluminescent panel system, when installed on a vehicle, may conform to the shape of the vehicle. An example is shown in FIGS. 5 to 8, in which the electroluminescent panel system has conformed to the shape of a rear of a vehicle, where the parts of the vehicle that are drawn are shown in dashed lines. The slits in the panel system enable the panels in the panel system to conform to the vehicle shape. FIGS. 5 to 7 show the panel system an illuminated state. FIG. 8 shows the panel system in a non-illuminated state.

Figure 9:
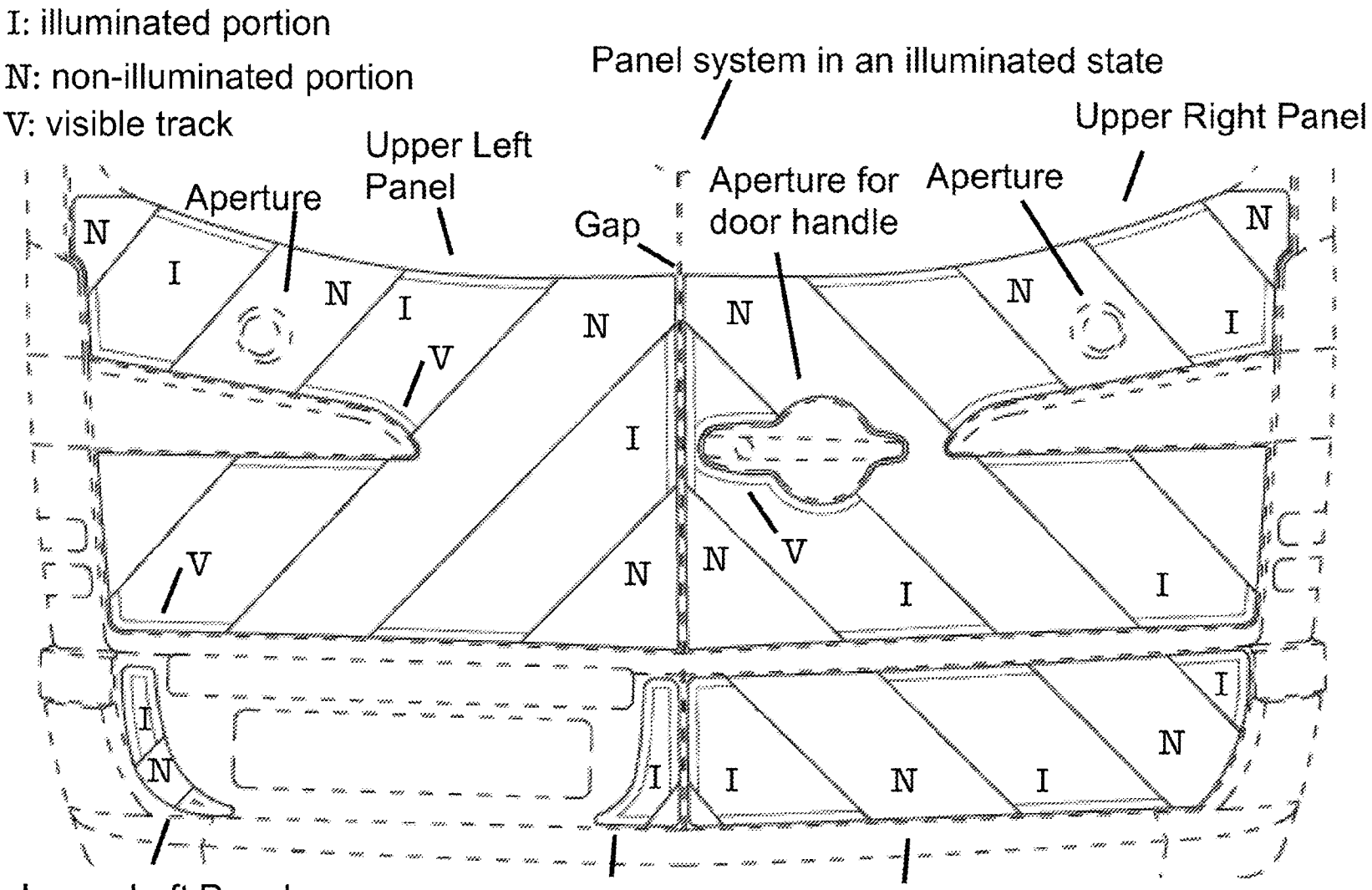
FIG. 9 shows a rear view of an example of an electroluminescent (EL) panel system in an illuminated state, when installed on a vehicle.

In an example of an electroluminescent panel system, for example comprising a plurality of electroluminescent panels, installed on a vehicle, when the panel system is in an illuminated state, the panel system may comprise illuminated portions and non-illuminated portions. The illuminated portions and non-illuminated portions may be arranged so as to form chevron shapes. Illuminated portions may be illuminated by virtue of an electroluminescent material emitting light. Non-illuminated portions may be formed by overlaying non-light emitting material over electroluminescent material which is used to provide light emission. For the illuminated portions, where conducting tracks are present on the periphery of the illuminated portions, the conducting tracks may not emit light, and hence may have a different appearance to the illuminated portions. Such a conducting track, which becomes visible by virtue of its not being illuminated, in contrast to the illuminated portions, may be referred to as a "visible conducting track" or as a "visible track". An example of an electroluminescent panel system in an illuminated state is shown in FIG. 7. An example of an electroluminescent panel system in an illuminated state is shown in FIG. 9, where the parts of the vehicle that are drawn are shown in dashed lines.

Figure 10:
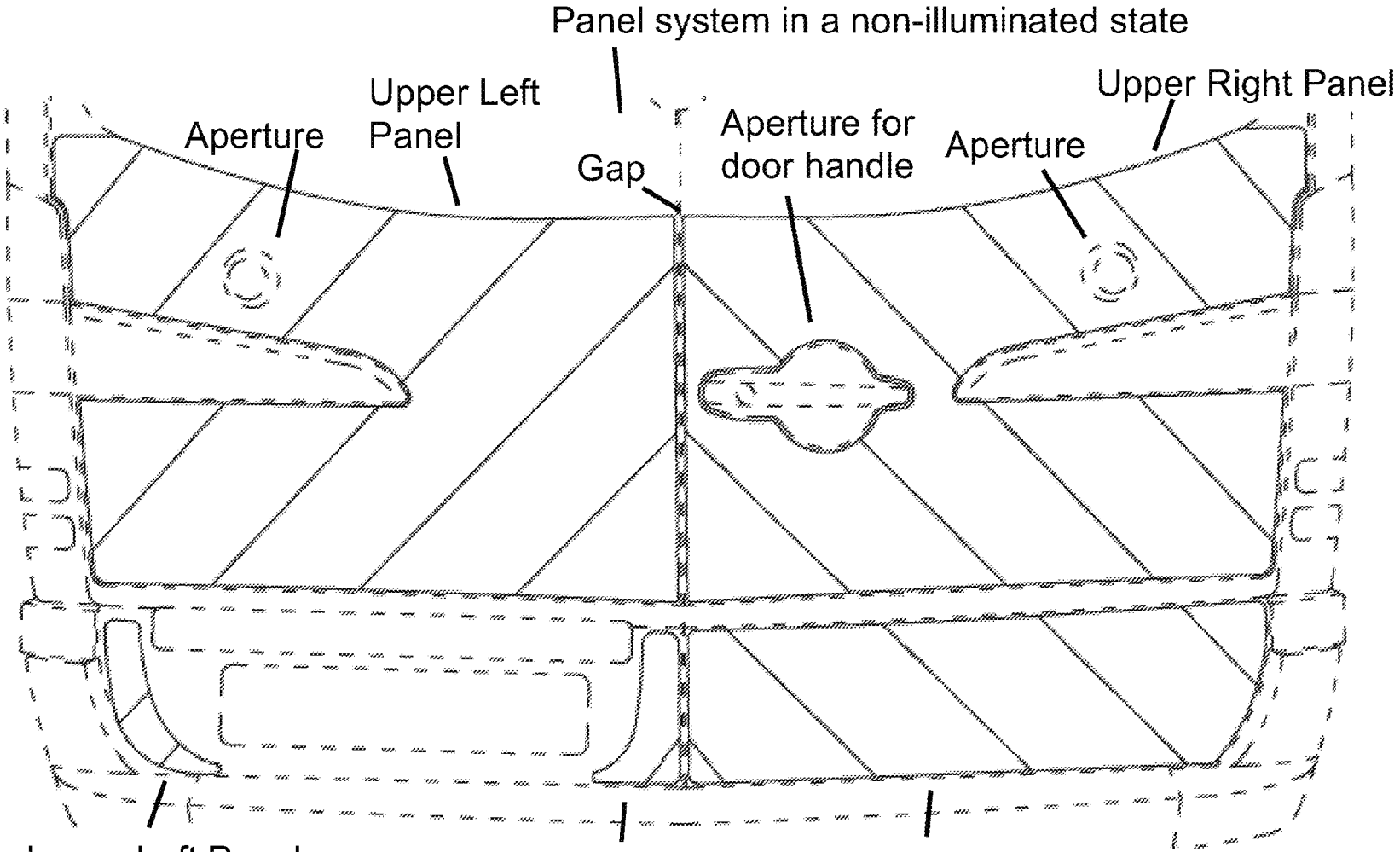
FIG. 10 shows a rear view of an example of an electroluminescent (EL) panel system in a non-illuminated state, when installed on a vehicle, corresponding to the example of an electroluminescent (EL) panel system in an illuminated state, when installed on a vehicle, shown in FIG. 9.

In an example of an electroluminescent panel system, for example comprising a plurality of panels, installed on a vehicle, when the panel system is in a non-illuminated state, the panel system may comprise light emitting portions which are not illuminated, and non-illuminated portions. The light emitting portions which are not illuminated and the non-illuminated portions may be arranged so as to form chevron shapes, and the light emitting portions and the non-illuminated portions will typically have different respective colours. For the light emitting portions which are not illuminated, where conducting tracks are present on the periphery of the illuminated portions, the conducting tracks may not emit light, and hence may have the same appearance as the light emitting portions which are not illuminated. In such circumstances the conducting tracks may not be visible, or apparent. An example of an electroluminescent panel system in a non-illuminated state is shown in FIG. 8. An example of an electroluminescent panel system in a non-illuminated state is shown in FIG. 10, where the parts of the vehicle that are drawn are shown in dashed lines.

Example Panel System Kit

An example panel system kit may include:

an electroluminescent (EL) panel
a Fluorescent yellow vinyl sheet
a UV laminate
Red reflective parts (e.g. Class 1 or Class 2, in the UK)
an Adhesive backing
Connectors with (e.g. 250 mm) tails
Fly leads nearside (e.g. 9300 mm)
fly leads offside (e.g. 7800 mm)
Panel connectors (e.g. Ingress Protection (IP) rated)
inverter (e.g. supplied, with flashing time period setting marked)
Visual guide for instruction on where to place tails
Panel alignment magnets (e.g. two per side of the panel)
Vinyl tail covers.

Regarding a guide to handling, the EL panel should not be heated (e.g. with a hot air blower). The EL panel should not be bent excessively or rolled up. The inverter should be kept away from water. The EL panel should not be pulled or lifted by cables (e.g. ribbon cables) with which it is in attachment. The EL panel should not be forced or pulled with force away from a vehicle to which it is attached. The inverter should not be lifted by cables with which it is in attachment.

Providing electrical power to a flexible electroluminescent (EL) panel system in a manner which is physically robust has proven to be a challenging problem. It has been found that attaching a power connector to the electroluminescent (EL) panel system, in which the power connector is flexible, e.g. similarly to the flexible electroluminescent (EL) panel system, provides a physically robust electrical power connection to the electroluminescent (EL) panel system. A panel or panels of a panel system, including a flexible power connector connected to the panel, or including a flexible power connector connected to each respective panel, may be capable of being curled such that the panel or panels each lies in a smooth continuous arcuate curve having a diameter of less than 1.0 m. A panel or panels of a panel system, including a flexible power connector connected to the panel, or including a flexible power connector connected to each respective panel, may be capable of being curled such that the panel or panels each lies in a smooth continuous arcuate curve having a diameter of less than 50 cm. A panel or panels of a panel system, including a flexible power connector connected to the panel, or including a flexible power connector connected to each respective panel, may be capable of being curled such that the panel or panels each lies in a smooth continuous arcuate curve having a diameter of less than 20 cm.

Instead, if a more rigid power connector is attached to a flexible electroluminescent (EL) panel system, the power connection may become unreliable, e.g. become cracked, or may break off, when the flexible electroluminescent (EL) panel system is flexed, or when the flexible electroluminescent (EL) panel system is subjected to a mechanical shock, such as when a vehicle on which the flexible electroluminescent (EL) panel system is mounted hits a bump or a hole in the road.

Figure 17A:
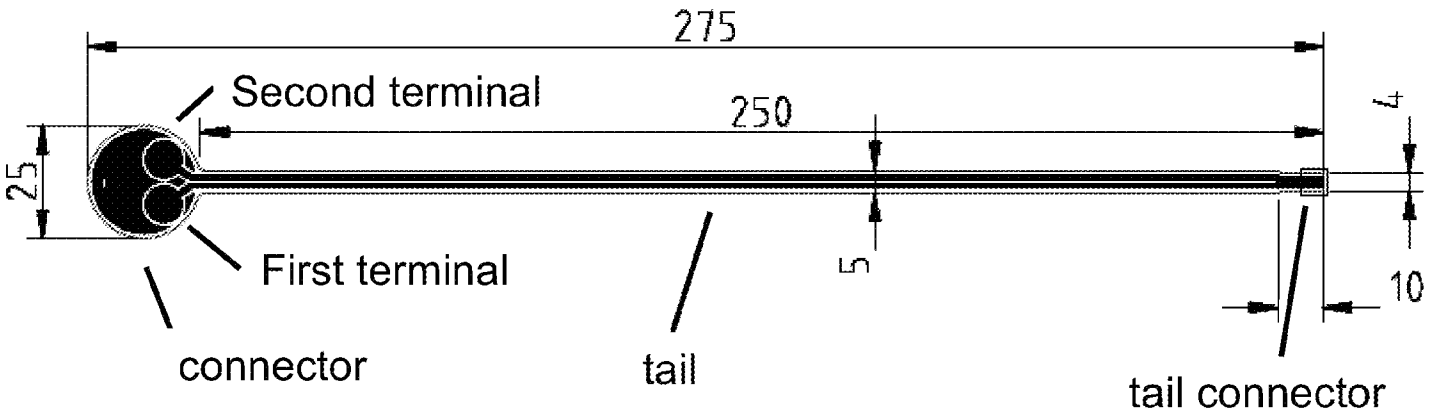
FIG. 17A shows an example of a flexible connector and tail system, which is attachable to (e.g. to a rear of) a flexible electroluminescent (EL) panel.
Figure 17B:
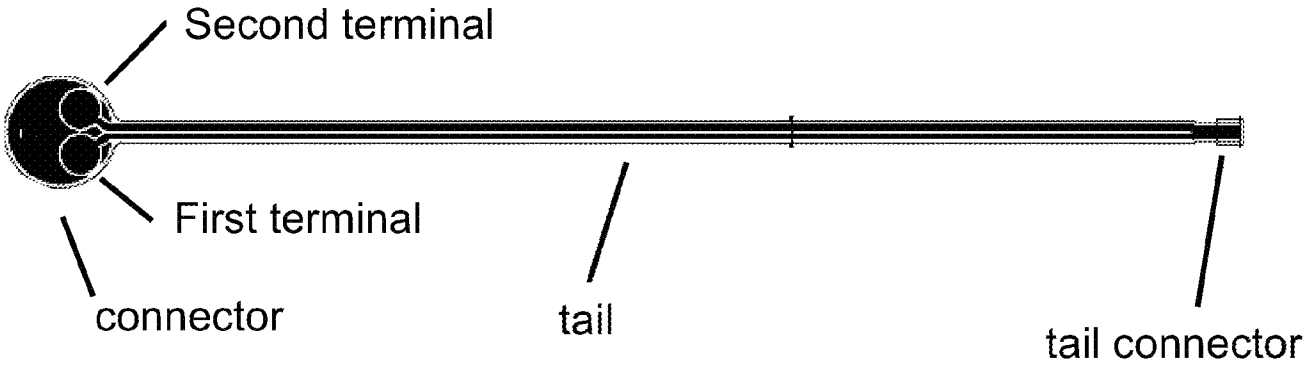
FIG. 17B shows an example of a flexible connector and tail system, which is attachable to (e.g. to a rear of) a flexible electroluminescent (EL) panel.
Figure 18:
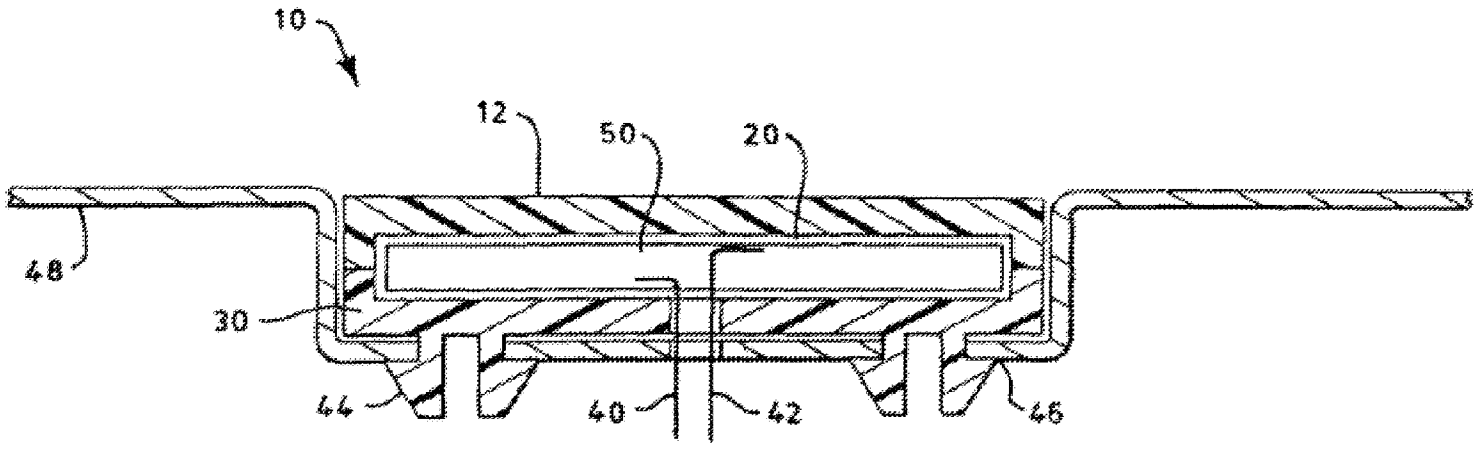
FIGURE 18 PRIOR ART
FIG. 18 shows a schematic cross sectional view of an electroluminescent vehicle lamp 10 according to prior art publication EP1110816 (A2).

In an example of a flexible electrical connector and tail system, which is attachable to (e.g. to a rear of) a flexible electroluminescent (EL) panel, the flexible electrical connector and tail system includes a connector, a tail and a tail connector. The connector includes a first terminal and a second terminal which are suitable for attachment to respective two terminals of a flexible electroluminescent (EL) panel. An example is provided in FIG. 17B.

In an example of a flexible electrical connector and tail system, which is attachable to (e.g. to a rear of) a flexible electroluminescent (EL) panel, the flexible electrical connector and tail system includes a connector, a tail and a tail connector. The connector includes a first terminal and a second terminal which are suitable for attachment to respective two terminals of a flexible electroluminescent (EL) panel. An example tail length is 250 mm. An example connector diameter is 25 mm. An example tail width is 5 mm. An example tail connector length is 10 mm. An example tail connector width is 4 mm. In an example, the tail thickness is in the range of 50 microns to 500 microns. In an example, the tail thickness is in the range of 100 microns to 300 microns. An example is provided in FIG. 17A, which includes example dimensions in mm.

In an example of a flexible electrical connector and tail system, which is attachable to (e.g. to a rear of) a flexible electroluminescent (EL) panel, conductive paths within the flexible electrical connector and tail system are provided by respective thin metal (e.g. copper) layers e.g. 35 microns thick. The respective thin metal layers (e.g. copper) may have thicknesses in the range of 20 microns to 60 microns. The respective thin metal layers may be insulated from the environment by being surrounded by a thin flexible insulating layer e.g. polyimide which is 25 microns thick, or by a flexible insulating layer (e.g. polyimide) which is in the range from 15 microns to 50 microns thick. The connector may be attached to a flexible electroluminescent (EL) panel by a flexible adhesive which is e.g. 25 microns thick, or which is e.g. in the range from 10 microns to 50 microns thick.

In an example, the internal structure of a flexible electrical connector and tail system comprises a copper polyimide laminate, for example a high temperature laminate of polyimide film bonded to high purity electrodeposited or rolled annealed copper foil. The bonding adhesive may be a flexible, flame retardant epoxy system which gives excellent heat resistance and ease of processing. An overlay may be provided which is a flame retardant epoxy coated polyimide. The copper clad laminate may be one suitable for flexible circuitry applications which require a high bond strength and temperature resistance. An example copper polyimide laminate is 7870S manufactured by GTS Flexible Materials Ltd, Rassau, Ebbw Vale, UK. An example epoxy adhesive is GTS 3600RFA manufactured by GTS Flexible Materials Ltd, Rassau, Ebbw Vale, UK. An example coverlay is GTS 3840RFA which is a flame retardant epoxy coated polyimide manufactured by GTS Flexible Materials Ltd, Rassau, Ebbw Vale, UK.

In an example, a flexible electrical connector, e.g. a flexible electrical connector and tail system, is attached to (e.g. to a rear of) a flexible electroluminescent (EL) panel via a controlled solder deposit.

In an example, a flexible electrical connector and tail system includes a connector, a tail and a tail connector, wherein the tail connector is connected inside a vehicle to a power supply (e.g. an inverter) located within the vehicle, in which the tail passes through an aperture in the vehicle body from outside the vehicle, to inside the vehicle.

In an example, a flexible electrical connector and tail system comprises a flat printed circuit cable (FPC) connector e.g. a polyimide flat printed circuit cable (FPC) connector.

In an alternative solution to connecting a flexible electroluminescent (EL) panel to a vehicle power supply system, a crimped flat printed circuit cable (FPC) connector and housing are used, which are fitted when the flexible electroluminescent (EL) panel is installed on a vehicle.

Figure 11:
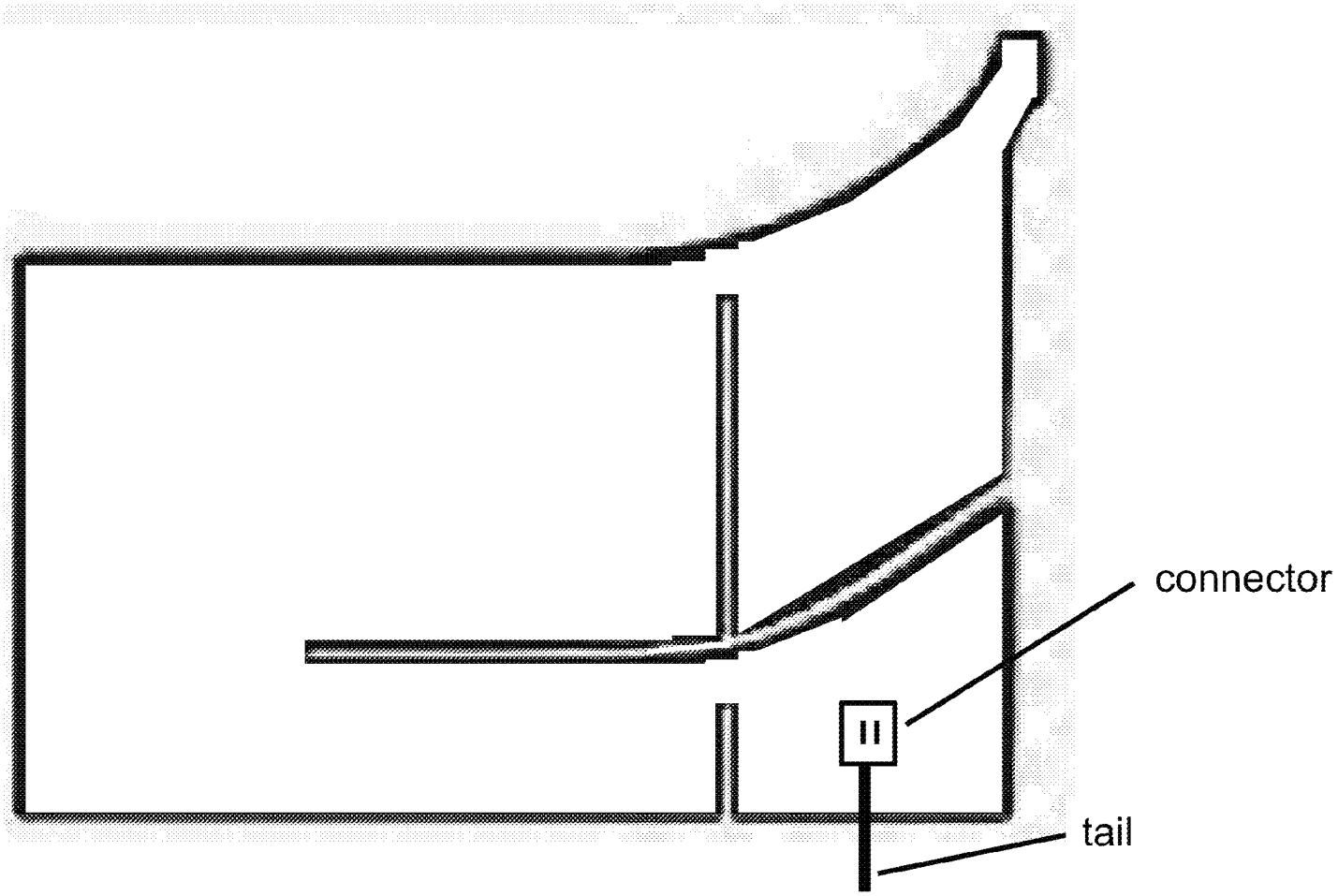
FIG. 11 shows an example of a connector and its tail attached to a rear of an electroluminescent (EL) panel.

A flexible electrical connector and tail system including a connector and its tail may be attached to a rear of a panel. A tail may be 250 mm long. A connector and its tail may be attached 150 mm from a side edge of a panel. A connector and its tail may be attached 50 mm from a bottom edge of a panel. A tail may be 5 mm wide. A tail may be 5 mm wide so as to pass through a 6 mm hole in a vehicle body e.g. in a vehicle door panel. FIG. 11 shows an example of a flexible electrical connector and tail system including a connector and its tail attached to a rear of a panel.

Figure 12:
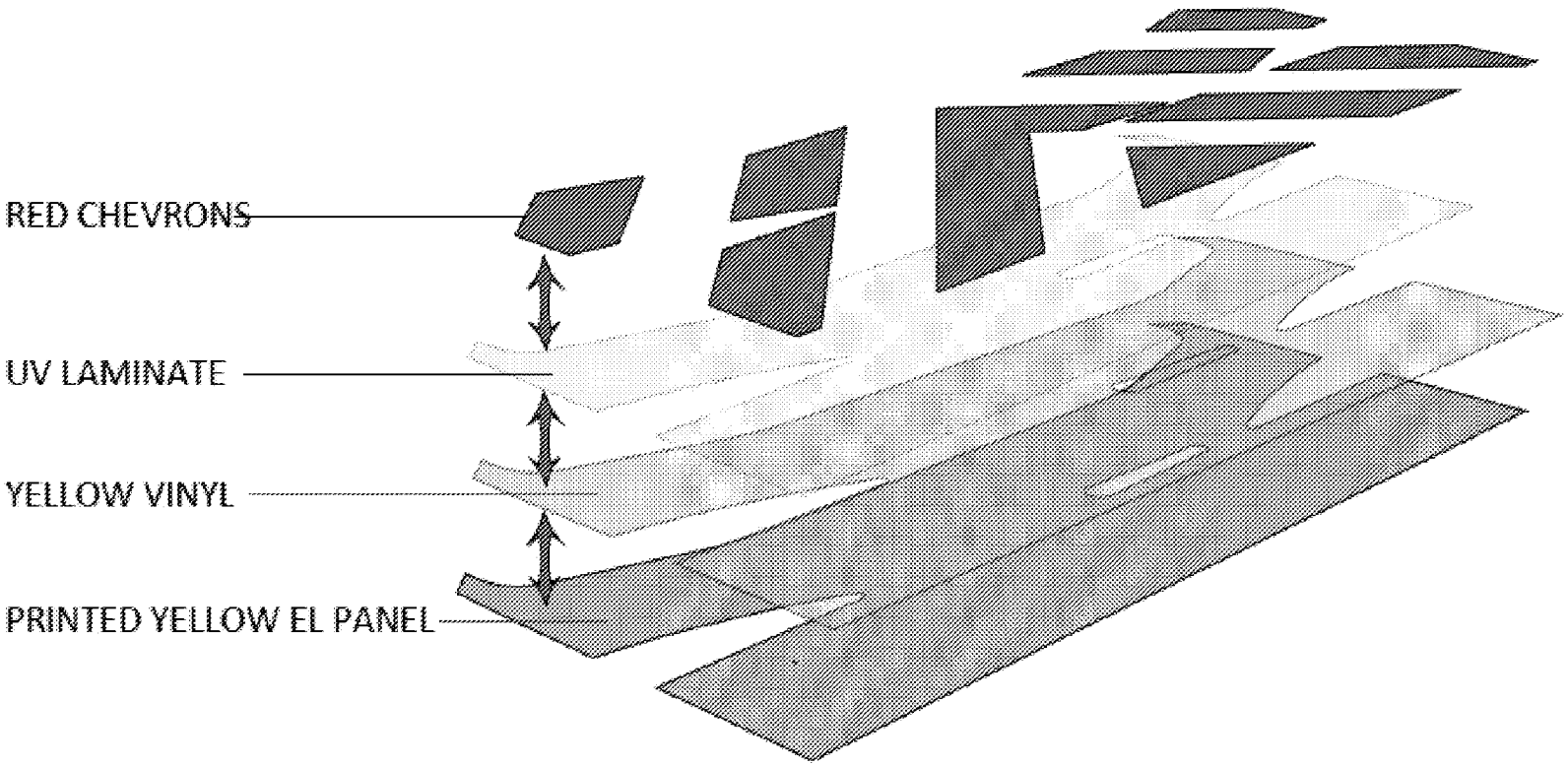
FIG. 12 shows an example of an electroluminescent (EL) panel, in an exploded view.

Viewed from a front side of an EL panel, there may be present at the back a (e.g. printed, e.g. yellow) EL panel, in front of which is a (e.g. yellow) fluorescent vinyl sheet, in front of which is a UV laminate, in front of which are (e.g. red) chevrons. An example is shown in FIG. 12.

Figure 13:
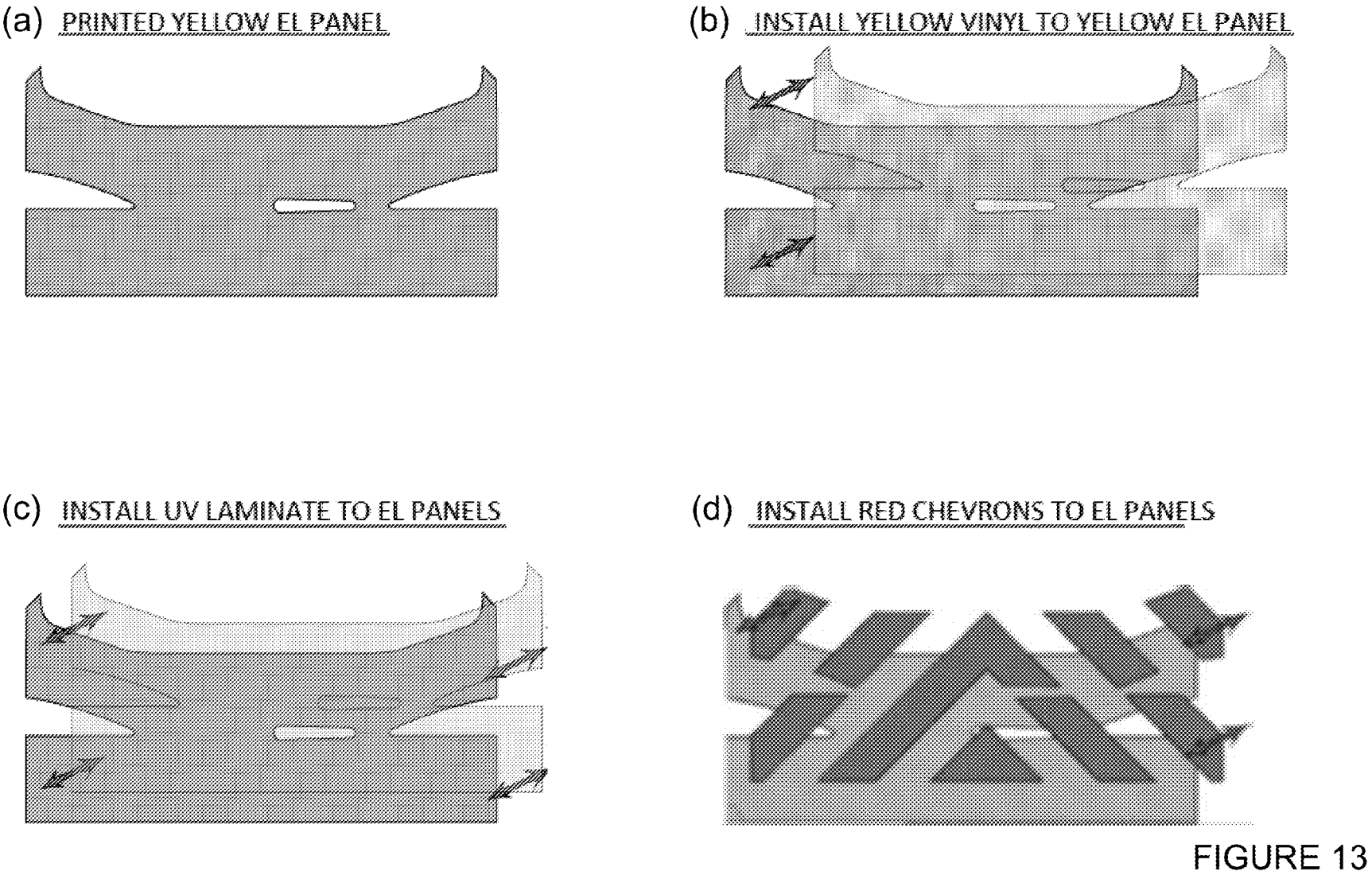
FIG. 13 shows an example method of assembly of an electroluminescent (EL) panel.

In an example method of assembly of a panel system, first (in step (a)) one starts with an EL panel (e.g. a printed yellow EL panel). Then (in step (b)) one installs a fluorescent vinyl sheet (e.g. a yellow vinyl sheet) onto the EL panel. Then (in step (c)) one installs the UV laminate onto the combined vinyl sheet and EL panel. In an example, the UV laminate is wrapped over the edges of the combined vinyl sheet and EL panel so as to reach onto the back side of the combined vinyl sheet and EL panel. Then (in step (d)) (e.g. red) chevrons are installed onto the UV laminate; in an example the (e.g. red) chevrons are installed onto the UV laminate with a gap (e.g. 5 mm) around the edge of the panel system. Red chevrons may include adhesive on their rear, for adhesion to the layer below. An example method of assembly of a panel system is shown in FIG. 13.

Figure 14:
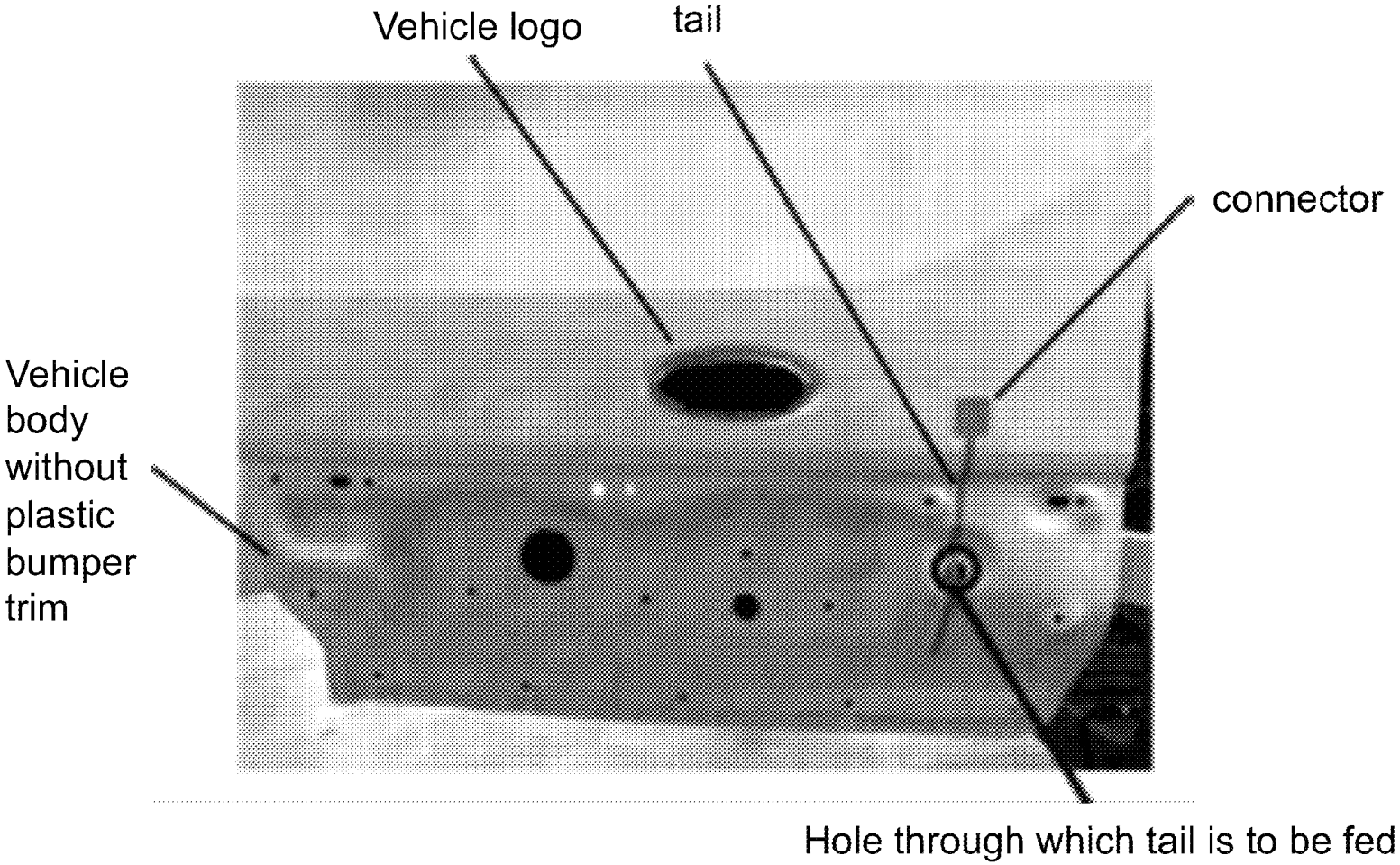
FIG. 14 shows an illustration in relation to an example of a method of connecting electrically a panel of a panel system to a power supply (e.g. an inverter) situated within a vehicle.

In an example method of connecting electrically a panel of a panel system to a power supply situated within a vehicle, plastic bumper trims are removed temporarily from the vehicle. A tail of a connector-plus-tail assembly is fed through a hole of a body of the vehicle, from outside the vehicle, into a vehicle interior, for connection within the vehicle to a lead which is in connection with an inverter power supply within the vehicle. Then the plastic bumper trims are reinstalled on the vehicle, which covers the hole used to feed through the tail from outside the vehicle, into a vehicle interior. An example is shown in FIG. 14. In FIG. 14, only the connector-plus-tail assembly of the panel is shown, to facilitate illustration of the example of the method of connecting electrically a panel of a panel system to a power supply (e.g. an inverter) situated within a vehicle.

Connectors connecting a tail from the panel and a power supply (e.g. an inverter) within the vehicle may include Ingress Protection (IP) rated connectors.

In an example method of connecting electrically a panel of a panel system to a power supply situated within a vehicle, a vehicle logo badge is temporarily removed from the vehicle. A tail of a connector-plus-tail assembly is fed through a hole of a body of the vehicle, behind where the vehicle logo badge is normally mounted, from outside the vehicle, into a vehicle interior, for connection within the vehicle to a lead which is in connection with an inverter power supply within the vehicle. Then the vehicle logo badge is reinstalled on the vehicle, which covers the hole used to feed through the tail from outside the vehicle, into a vehicle interior. An advantage of a tail is that it may readily be fed through a hole of a body of the vehicle, because of the flexibility of the tail. The flatness of a tail assists with maintaining a flat profile of the panel system when mounted on the vehicle.

In an example method of connecting electrically a panel of a panel system to a power supply situated within a vehicle, a number plate light holder is temporarily removed from the vehicle. A tail of a connector-plus-tail assembly is fed through a hole of a body of the vehicle, behind where the number plate light holder is normally mounted, from outside the vehicle, into a vehicle interior, for connection within the vehicle to a lead which is in connection with an inverter power supply within the vehicle. Then the number plate light holder is reinstalled on the vehicle, which covers the hole used to feed through the tail from outside the vehicle, into a vehicle interior.

An example panel system kit may include:

a nearside electroluminescent (EL) panel
an offside electroluminescent (EL) panel
a Connector with (e.g. 250 mm) tail for the nearside
a Connector with (e.g. 250 mm) tail for the offside
a fly lead for the nearside (e.g. 9300 mm)
a fly lead for the offside (e.g. 7800 mm)
Panel connectors (e.g. Ingress Protection (IP) rated)
an inverter When a panel system is installed onto a vehicle, it should be confirmed that the panels can be illuminated, and that the desired flashing period (if any) has been set, e.g. using a setting on the inverter. In an example, fly leads are orange. In an example, a tail of a connector-and-tail assembly includes adhesive tape fitted on the panel-facing side of the tail, so that the tail may be affixed to the panel. In an example, vinyl tape is used to cover exposed parts of tails. In an example, a panel system kit includes alignment magnets to assist with placement of the kit on a vehicle body.

An example panel system kit may include:

nearside electroluminescent (EL) panels, top and bottom
offside electroluminescent (EL) panels, top and bottom
Connectors with (e.g. 250 mm) tails for the nearside top and bottom panels
Connectors with (e.g. 250 mm) tails for the offside top and bottom panels
two fly leads for the nearside (e.g. 9300 mm) (top and bottom)
two fly leads for the offside (e.g. 7800 mm) (top and bottom)
Panel connectors (e.g. Ingress Protection (IP) rated)
an inverter.

Figure 15:
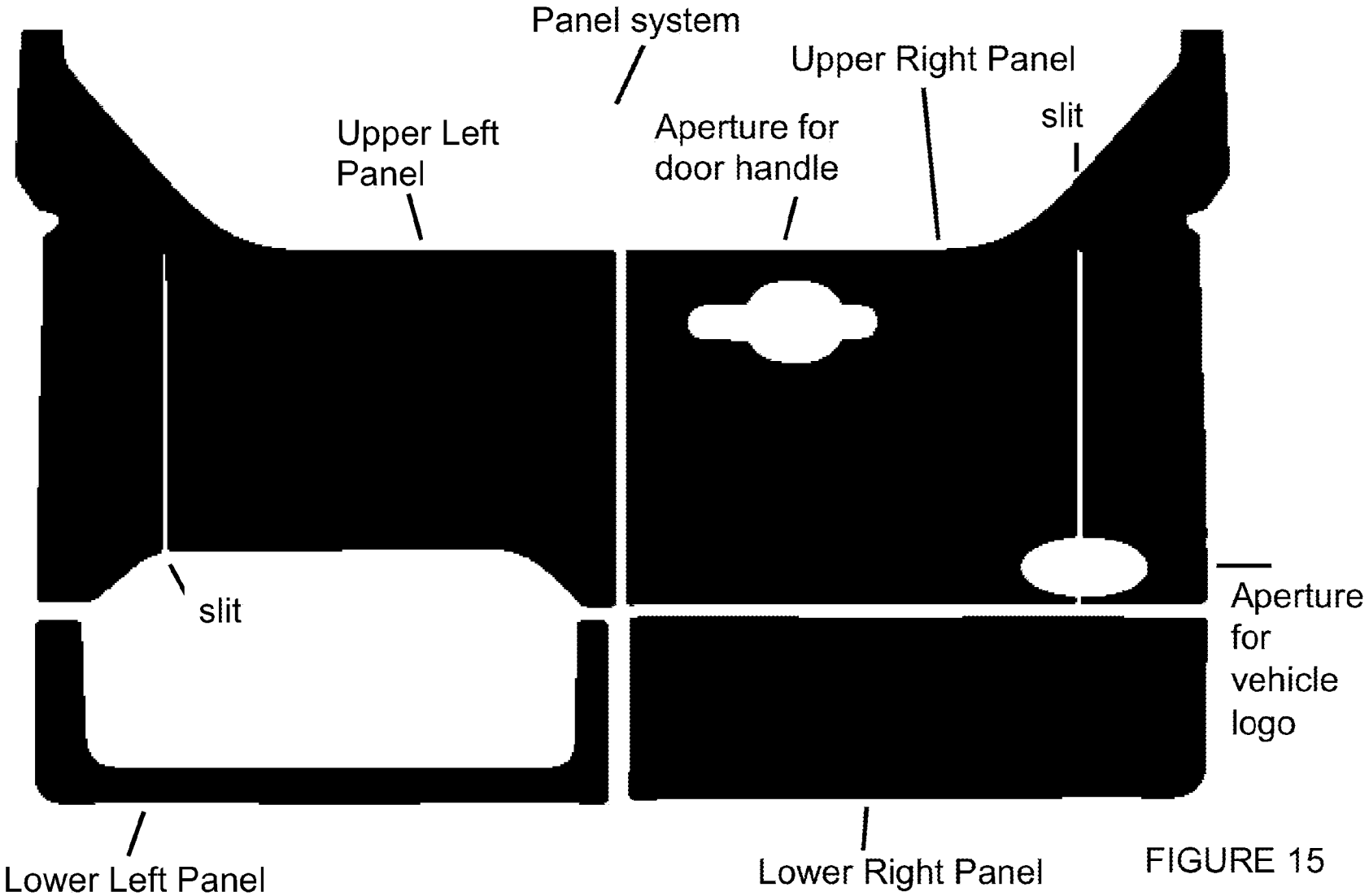
FIG. 15 shows an example of an electroluminescent (EL) panel system.

A panel system may include an upper left panel, an upper right panel, a lower left panel and a lower right panel. An example is shown in FIG. 15.

Figure 16:
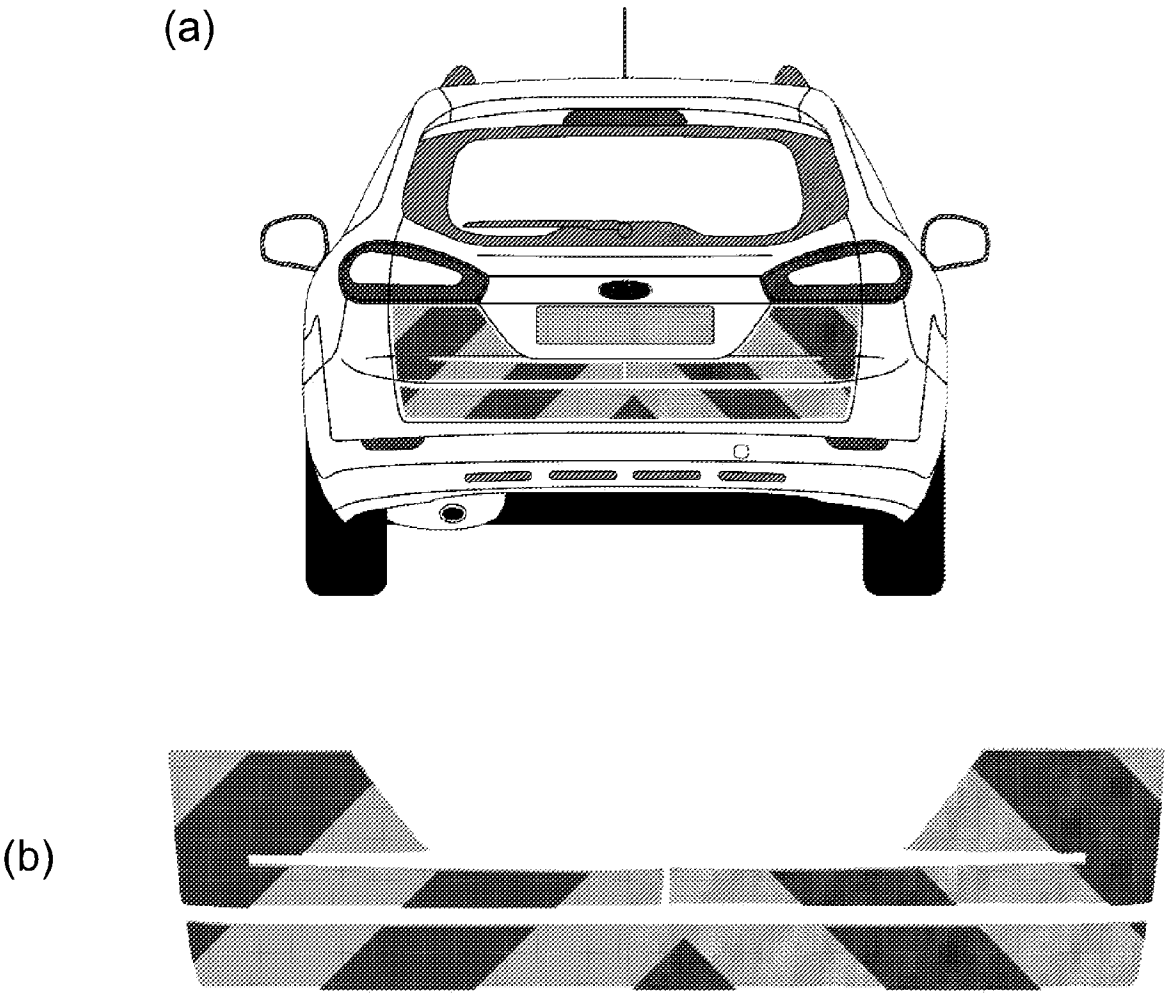
FIG. 16 shows (a) an example of an electroluminescent (EL) panel system installed on the rear of a car (automobile), and (b) an example of an electroluminescent (EL) panel system which is suitable for installation on the rear of a car (automobile).

In an example, an electroluminescent (EL) panel system is installed on the rear of a car (automobile) (e.g. a Ford Mondeo). An example of an electroluminescent (EL) panel system installed on the rear of a car (automobile) is shown in FIG. 16(*a*). In an example, an electroluminescent (EL) panel system is provided which is suitable for installation on the rear of a car (automobile). An example of an electroluminescent (EL) panel system which is suitable for installation on the rear of a car (automobile) is shown in FIG. 16(*b*).

In an example of an electroluminescent (EL) panel system, the panel system comprising a plurality of electroluminescent (EL) panels, a ribbon cable supplies power to each panel of the panel system. The flatness of a ribbon cable assists with maintaining a flat profile of the panel system. An electroluminescent (EL) panel system may be configured such that the electroluminescent (EL) panel system will only illuminate if a vehicle handbrake is on.

In an example, an electroluminescent (EL) panel system including a remote control is provided, wherein the system is configured such that the remote control is operable to turn on electroluminescent (EL) panels of the electroluminescent (EL) panel system, and to turn off electroluminescent (EL) panels of the electroluminescent (EL) panel system.

In examples, electroluminescent (EL) panel systems may be provided for vehicles of the following the vehicle manufacturers and vehicle models.

Toyota Hilux Extra Hard Top
Citroen Relay
Dacia Dokker
Ford Ranger
Ford Transit L2 H2
Ford Transit L2 H3
Ford Transit Connect
Ford Transit Courier
Ford Transit Custom SD
Ford Transit Custom TG
Ford Transit Custom SD
Isuzu D-Max Ext
Iveco Daily SD
Iveco Daily Recovery Truck
Land Rover Discovery 3
MAN TGE SD
Mercedes Citan SD
Mercedes Citan SD Glz
Mercedes Sprinter SD
Mercedes Vito SD
Peugeot Partner Van
Renault Kangoo SD
Renault Master SD
Renault Trafic SD
Vauxhall Vivaro SD
Volkswagen Caddy SD
Volkswagen Crafter SD
Volkswagen Transporter TG
Trident Recovery
Komatsu PC220 Excavator
Komatsu PC390 Excavator
Komatsu WA320 Loader

NOTE

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred example(s) of the invention, it will be apparent to those of ordinary skill in the art that numerous modifications can be made without departing from the principles and concepts of the invention as set forth herein.

The invention claimed is:

1. A flexible panel, including
(i) a fluorescent layer;
(ii) an electroluminescent panel layer arranged to illuminate the fluorescent layer;
(iii) an ultraviolet protection layer, transparent to visible light, arranged on a front face of the flexible panel to protect the fluorescent layer, and
(iv) an adhesive layer;
wherein the adhesive layer is arranged on a rear face of the flexible panel, such that the flexible panel is attachable to a surface.

2. The flexible panel of claim 1, wherein the flexible panel includes an optically opaque pattern layer arranged so as to be visible from the front face of the flexible panel.

3. The flexible panel of claim 2, wherein the optically opaque pattern layer is retroreflective.

4. The flexible panel of claim 2, wherein the optically opaque pattern layer is an optically opaque chevron pattern layer.

5. The flexible panel of claim 4, wherein the optically opaque chevron pattern layer is arranged such as to leave visible a chevron pattern of the fluorescent layer.

6. The flexible panel of claim 2, wherein the fluorescent layer is a first colour, and the optically opaque pattern layer is a second colour, different to the first colour.

7. The flexible panel of claim 6, wherein the fluorescent layer is yellow, and the optically opaque pattern layer is red.

8. The flexible panel of claim 6, wherein the fluorescent layer is white, and the optically opaque pattern layer is red.

9. The flexible panel of claim 4, wherein the optically opaque chevron pattern layer is red and includes red strips being no less than 150 mm apart with an incline of between 45-60° to the vertical.

10. The flexible panel of claim 1, wherein the flexible panel includes an aperture passing from the front face to the rear face.

11. The flexible panel of claim 10, wherein the aperture is for a vehicle door handle, or for a vehicle logo or badge.

12. The flexible panel of claim 1, wherein the flexible panel includes a slit.

13. The flexible panel of claim 12, wherein the slit is adapted to enable the flexible panel, when affixed to a vehicle, to conform to a curved shape of the vehicle, such as a curved shape of a rear of a van.

14. The flexible panel of claim 1, wherein the flexible panel includes a plurality of slits.

15. The flexible panel of claim 14, wherein at least two slits of the plurality of slits are arranged non-parallel to each other, in the flexible panel.

16. The flexible panel of claim 15, wherein the at least two slits of the plurality of slits are arranged perpendicularly in the flexible panel.

17. The flexible panel of claim 14, wherein the plurality of slits are adapted to enable the flexible panel, when affixed to a vehicle, to conform to a curved shape of the vehicle, such as a curved shape of a rear of a van.

18. The flexible panel of claim 1, wherein the flexible panel is capable of being curled such that the flexible panel lies in a smooth continuous arcuate curve having a diameter of less than 1.0 m.

19. A flexible panel system, the system including a flexible panel and an inverter power system, wherein the flexible panel is in connection with the inverter power system, the flexible panel including (i) a fluorescent layer;

(ii) an electroluminescent panel layer arranged to illuminate the fluorescent layer;

(iii) an ultraviolet protection layer, transparent to visible light, arranged on a front face of the flexible panel to protect the fluorescent layer, and (iv) an adhesive layer;

wherein the adhesive layer is arranged on a rear face of the flexible panel, such that the flexible panel is attachable to a surface.

20. A method of assembly of a flexible panel, the method including the steps of (a) installing a fluorescent sheet onto an EL panel;

(b) installing a UV laminate onto the combined fluorescent sheet and EL panel;

(c) wrapping the UV laminate over edges of the combined fluorescent sheet and EL panel so as to reach onto a back side of the combined fluorescent sheet and EL panel; and (d) installing retroreflective sheet material onto the UV laminate.

* * * * *